United States Patent [19]

Oberlander

[11] 4,434,698

[45] Mar. 6, 1984

[54] TRANSPOSABLE SHEET MUSIC

[75] Inventor: Charles N. Oberlander, El Paso, Tex.

[73] Assignees: Ronald H. Mishkin, Lake Hopatcong; James T. Pappas, Chatham; W. Patrick Quast, Waldwick, all of N.J. ; part interest to each

[21] Appl. No.: 259,808

[22] Filed: May 4, 1981

[51] Int. Cl.[3] ..... G10G 1/04

[52] U.S. Cl. ..... 84/483 A; 283/47

[58] Field of Search ..... 84/470 R, 471–474, 84/477 R, 480, 483; 283/47

[56] References Cited

U.S. PATENT DOCUMENTS

| | | | |
|---|---|---|---|
| 659,113 | 10/1900 | Turner | 84/480 |
| 1,436,771 | 11/1922 | Meling | 84/473 |
| 2,271,772 | 2/1942 | Maffei | 84/483 A |
| 3,736,833 | 6/1973 | Alvarado | 84/473 |

*Primary Examiner*—Lawrence R. Franklin

*Attorney, Agent, or Firm*—W. Patrick Quast

[57] ABSTRACT

A system for devising a sheet of music and for transposing the music from one key to another. A layer of opaque material having standard music indicia disposed thereon is interposed typically between a first and second overlay of transparent material which includes additional musical indicia. Additional indicia disposed on the overlays transparent is in the form of opaque areas which match the color of the opaque material. Cooperating indicia in the opaque layer and transparent overlays permit alignment of the two for a desired key. The aligning indicia are disposed in predetermined relationship to the staff lines and other music notations such that when the opaque layer is adjusted relative to the transparent overlay, any one of the 13 possible keys can be selected. The dimensional relationships among the various music notations and staff lines, for one embodiment, reflect the difference in relative motion between the opaque layer and each of the transparent overlays. A chord guide simultaneously aligned with the key selection is provided employing the Roman numeral designation approach to representing music chords, but which also provides a way by which the musician can transpose from the Roman numeral system to the, perhaps, more familiar letter designating system. Three different embodiments employing cooperating aligning indicia and apparatus are disclosed. Further, a cooperating cam-cutout arrangement is described wherein a positive locking between the opaque layer and the transparent overlays is effected, once the desired key is selected.

15 Claims, 52 Drawing Figures

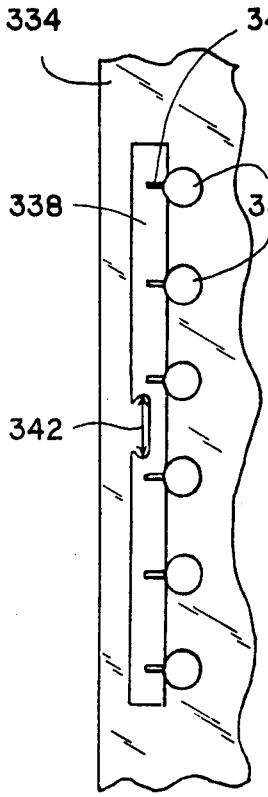
FIG. 42
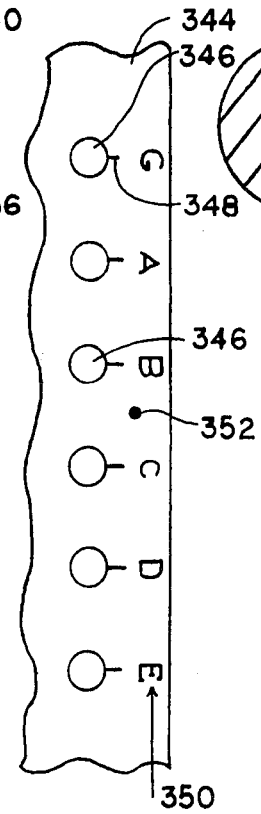
FIG. 43
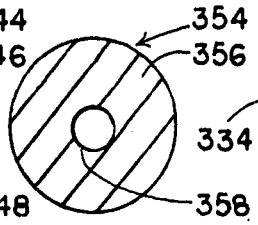
FIG. 44
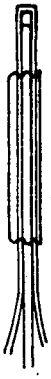
FIG. 45
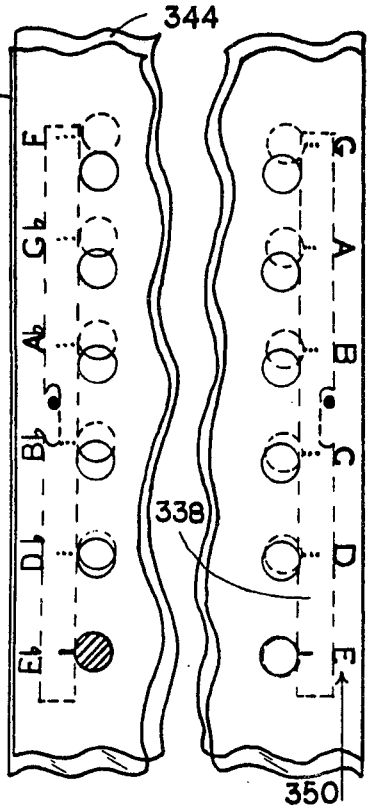
(a) FIG. 46 (b)
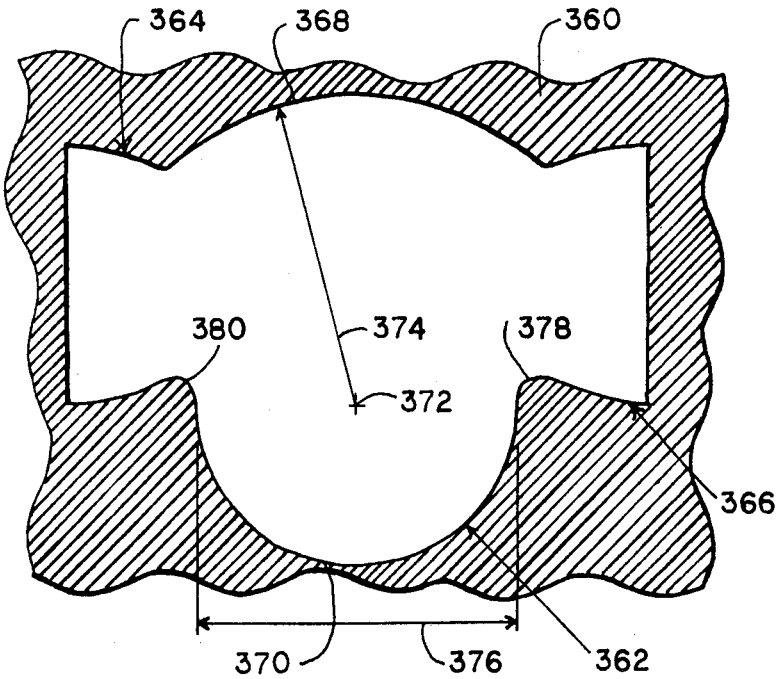
FIG. 47 (a)
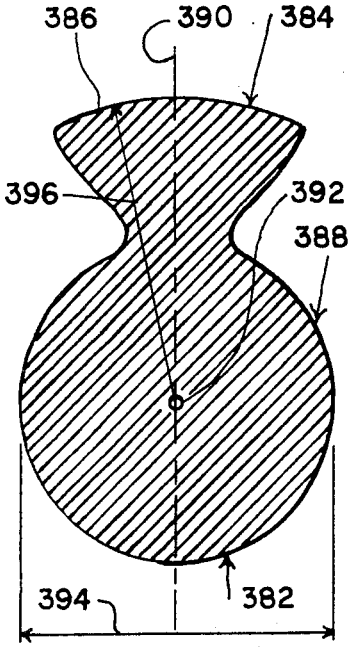
(b)

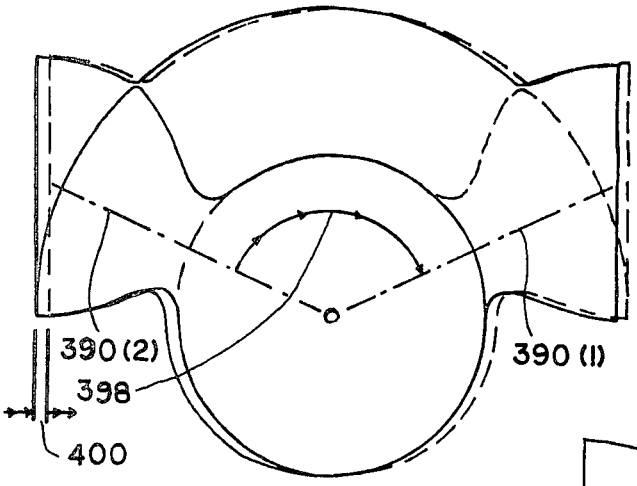
FIG. 47 (c)
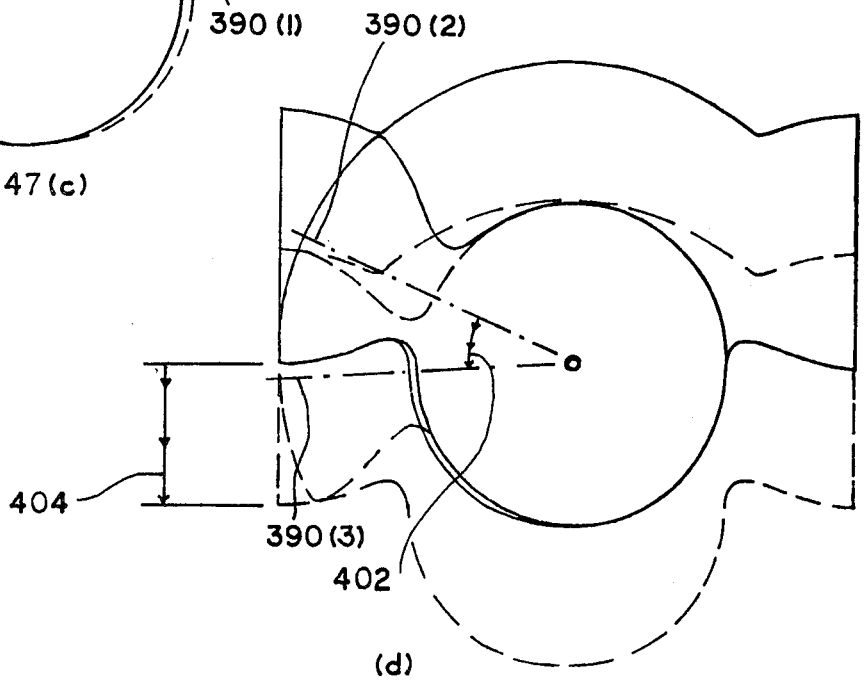
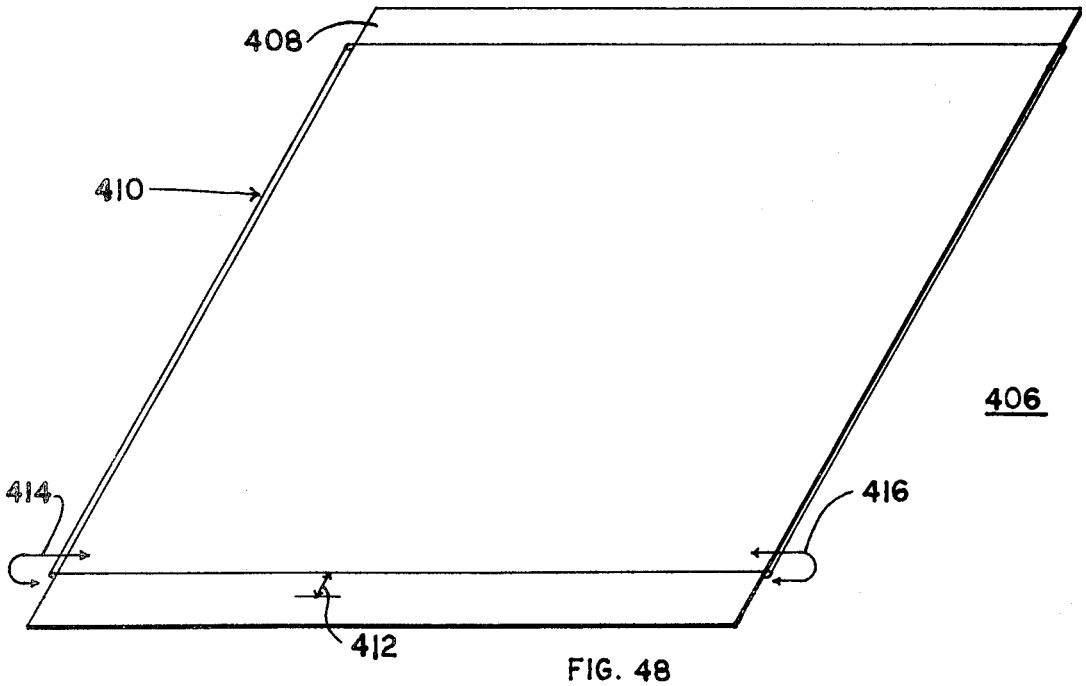
FIG. 48

TRANSPOSABLE SHEET MUSIC

BACKGROUND OF THE INVENTION

1. Field of the Invention

This invention pertains to means for devising sheet music, and, in particular, to means for devising sheet music and for readily transposing the music into any desired music key.

DESCRIPTION OF THE PRIOR ART

No means for devising sheet music which is transposable from one key to another, or to any desired key, using standard musical notations is known in the prior art. Attempts in this direction have comprised complex variations from the standards, require the use of unfamiliar, non-conventional musical notations, or they utilize new clef line arrangements based on the piano keyboard, attempting to eliminate the key signature. Other efforts designate what are the corresponding notes in two different keys, taking one note at a time. Consequently, it still remains necessary for musicians to rewrite a music piece into a new key, note by note. Obviously this is time consuming and tedious.

It is an object of this invention therefore to provide a simple means for devising sheet music in a given key, and for transposing the devised music from one key to any other key.

It is another object to provide a transposition scheme which is simple and easy to use, requires few, if any, non-standard notations, and lends itself to the key transposure of substantially all popular music.

It is still another object of this invention to provide a transposition device which is adaptable as a valuable teaching tool.

SUMMARY OF INVENTION

Towards the accomplishment of these and other objects and advantages which will become apparent hereinafter, there is described a system for devising a sheet of music and for transposing the music from one key to another which comprises a layer of opaque material having indicia disposed thereon including music notes, abbreviated staff lines, chord guide characters, a plurality of sharps and flats representing all possibilities as to any desired playing key; the layer of opaque material is interprosed typically between a first and second overlay of transparent material which includes additional indicia, for example, staff lines, and music notations which remain stationary relative to the staff lines, when a key change is made. Typically, these include clef notations, time signature, certain rests, etc. Additional indicia disposed on the overlays is in the form of opaque areas which match the color of the opaque material. Further, the layer of opaque material and at least the obverse layer of transparent material includes additional cooperating indicia which permit alignment of the opaque layer with the transparent overlays. The aligning indicia allows the user to select a desired key whereby various indicia on the opaque layer are obscured by corresponding opaque areas on the transparent overlay such that only the musical notations and their appropriate location with respect to the staff lines, pertaining to the selected key, appear to the musician. The aligning indicia are disposed in predetermined relationship to the staff lines and other musical notations such that when the opaque layer is adjusted relative to the transparent overlay, any one of the 13 possible keys can be selected.

The dimensional relationships among the various music notations and staff lines, for one embodiment, reflect the difference in relative motion between the opaque layer and the transparent overlays, as between the obverse side of the composite and the reverse side. Two embodiments are disclosed for implementing the key signature areas of the composite system.

A chord guide is provided employing the Roman numeral designation approach to representing music chords, but which also provides a way by which the musician can transpose from the Roman numeral system to the, perhaps, more familiar letter designating system. The transposition of the chord guide for any desired key occurs simultaneously with the alignment of the opaque layer and the transparent overlays in selecting a particular key.

Three different embodiments employing cooperating aligning indicia and apparatus are disclosed. Further, a cooperating cam-cutout arrangement is described wherein a positive locking between the opaque layer and the transparent overlays is effected, and the desired key is selected.

DESCRIPTION OF THE DRAWINGS

Further objects of this invention, as well as the novel features thereof, will become more apparent by reference to the following description, taken in conjunction with the accompanying figures, in which:

FIGS. 42, 43, 44, 45 and 46(*a*)–(*b*) are detail views of yet another key setting means that uses plug-like buttons in cooperative arrangement with the overlays and sheets to effect the necessary registry.

FIGS. 47(*a*), (*b*), (*c*) and (*d*) depict a camming means arrangement for aligning the opaque sheet and overlay.

FIG. 48 depicts another embodiment of the proposed system.

DESCRIPTION OF THE PREFERRED EMBODIMENT

Figure 1:
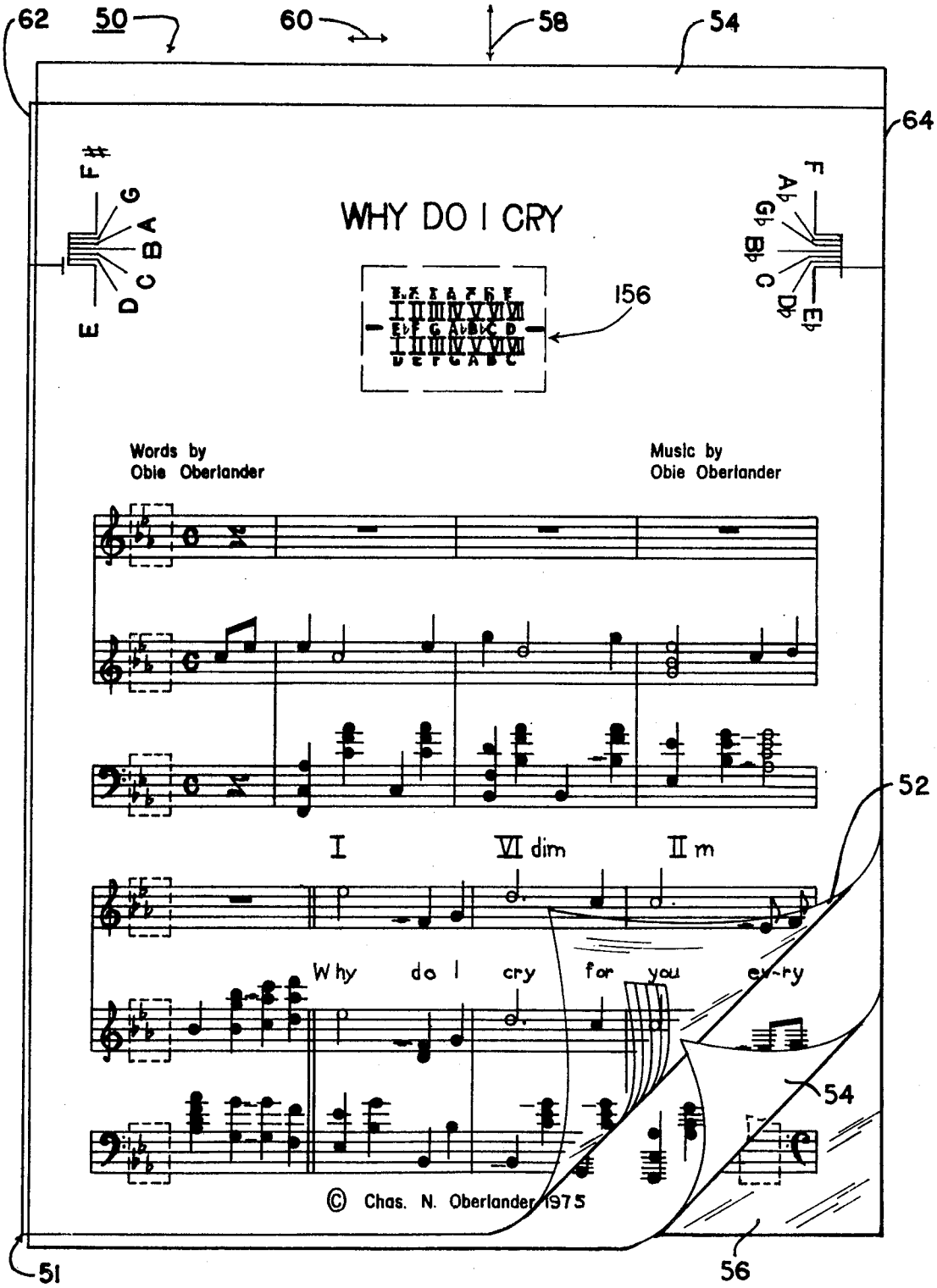
FIG. 1 is an elevational view of an embodiment of the devised music and key transposing system according to this invention.

As shown in FIG. 1 of the drawings, an embodiment 50 of the novel transposable music system comprises a substantially transparent envelope 51, having a first overlay 52, an opaque sheet 54, and a second overlay 56. The latter is also substantially transparent and joined at the left and right edges so as to be continuous with the first overlay 52. The right edge of the embodiment is shown as if cut in the lower right hand corner. This generally would not be the case and it is only shown as such to further a better understanding of the arrangement between the overlays and the opaque sheet. Again, preferably the side edges are joined in some fashion to form the envelope 51. In this embodiment, the opaque sheet 54 is a single sheet and is printed on both sides. It has no clef symbols or staffs thereon, but includes all music notations and other characters that normally change position, appear or disappear, relative to the staffs, when a key change is made. A further discussion follows with respect to FIG. 3.

The opaque sheet 54 in the assembled system is movably interposed in the envelope 51 between the first and second overlays. It has freedom to move in the direction of the arrow 58. It is restrained in its movement in direction of arrow 60 by the side edges 62 and 64 of the envelope.

Figure 2:
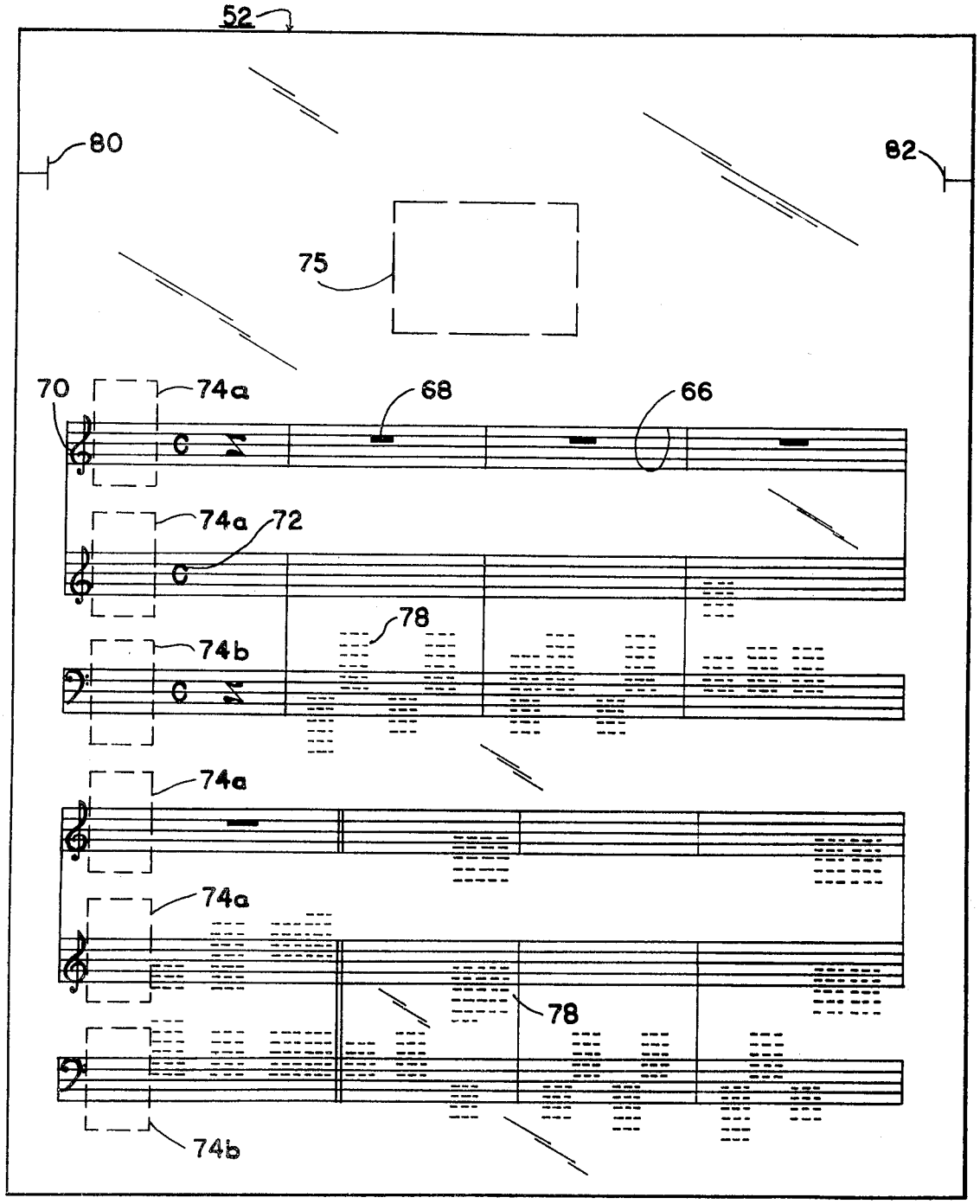
FIG. 2 is a view of the first overlay shown in FIG. 1, without the opaque sheet or second overlay.

The first overlay 52, shown separately in FIG. 2, has printed thereon, the staff lines 66 and music notations 68, 70 and other characters that should remain stationary, relative to the staff lines, when a key change is made, e.g., some rests, clef notations, time signature etc. Another printing on the overlay involves opaquing certain portions with a color that matches the opaque sheet 54 in color shade. This provides a plurality of opaque areas for the purpose of obscuring certain music notations and other characters when not needed in the particular key chosen. The opaque areas are depicted as the boxed areas, 74 and 75; and a plurality of dashed lines, such as at 78, throughout the sheet, representing solid opaque lines. The opaque areas represented by boxes 74 and 75 will be discussed hereinafter but include precision-designed "windows", allowing only those notations on the opaque sheet to show through as required for a particular key setting. This is shown in greater detail on subsequent drawings. The opaque printing and color of the opaque sheet 54 are contrasting shades relative to the other printings. The first overlay also includes "tee" shaped characters 80, 82, used in the aligning of the sheet to the overlay as explained hereinafter.

The first overlay 52 has a plurality of identical opaque areas 74*a*, 74*b*; whereas the second overlay 56 has a plurality of identical opaque areas slightly altered from the set on the first overlay. With respect to the opaque areas, the only difference between areas designated 74*a* and 74*b* on the first overlay, for example, is that they occupy a different position on the staff, depending on whether the staff is indicated as treble clef or bass clef, respectively. The same applies to opaque areas on overlay 56.

Figure 3:
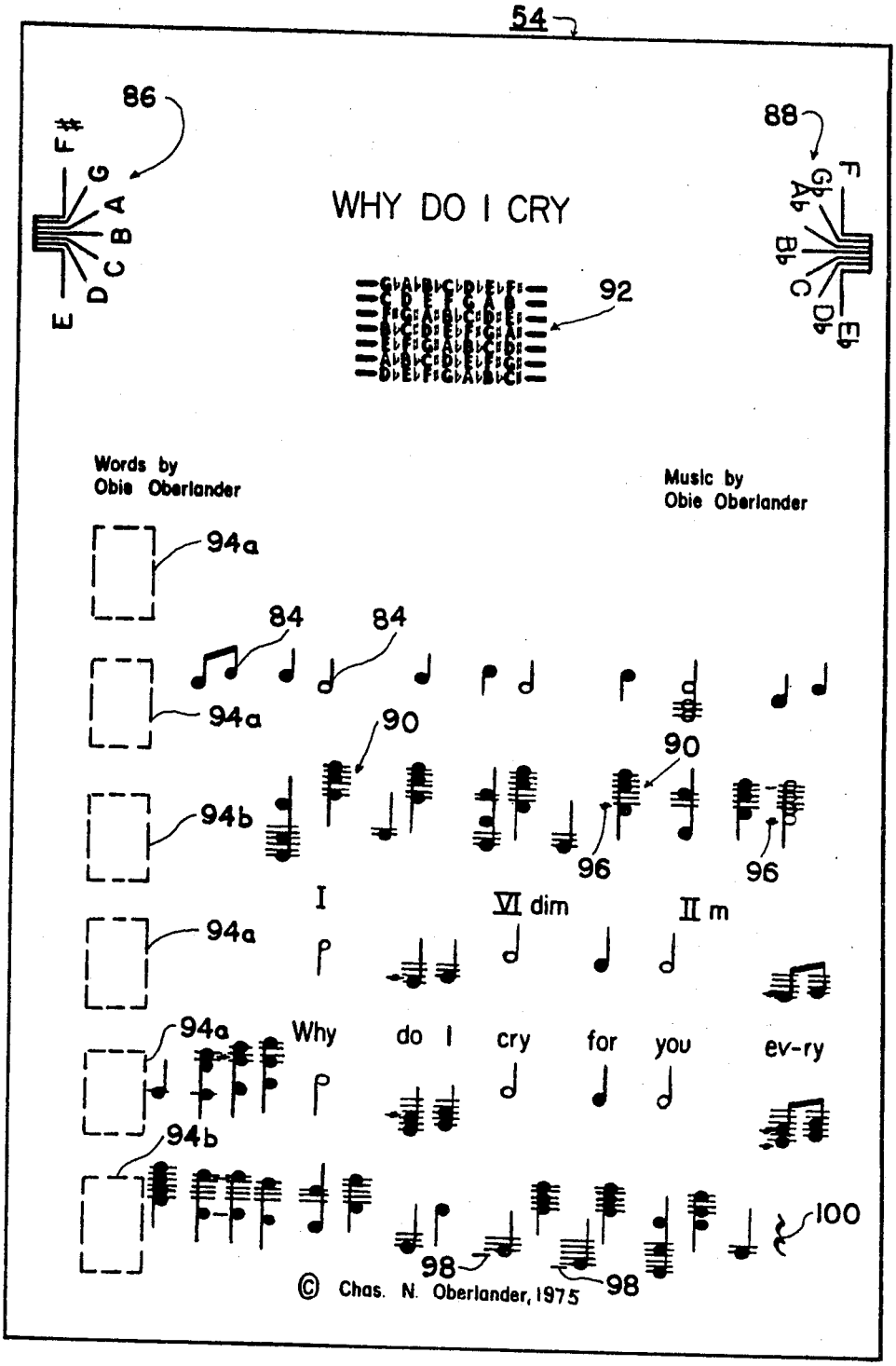
FIG. 3 is a view of the obverse of front side of the opaque sheet of the system of FIG. 1, without the overlays.

FIG. 3 depicts the obverse or near side of the opaque sheet 54. It includes printed characters which comprise the notes of the song, 84; aligning guides, 86 and 88, for sharp and flat key signatures, respectively; additional, abbreviated staff lines 90, to supplement the staff lines 66, on the overlay 52; chord guide characters, 92, which are used in conjunction with the boxed area, 75, on overlay 52 in a manner to be described in further detail hereinafter; key signature notations (not detailed in this figure) shown generally at 94*a* and 94*b* which also cooperate with a corresponding area, 74*a* and 74*b*, on the overlay to present to the viewer the composite key signature for the chosen key; the augment and diminish accidentals, 96 and 98; and, an occasional rest notation, 100, whose position on the staff would vary with the key.

Figure 4:
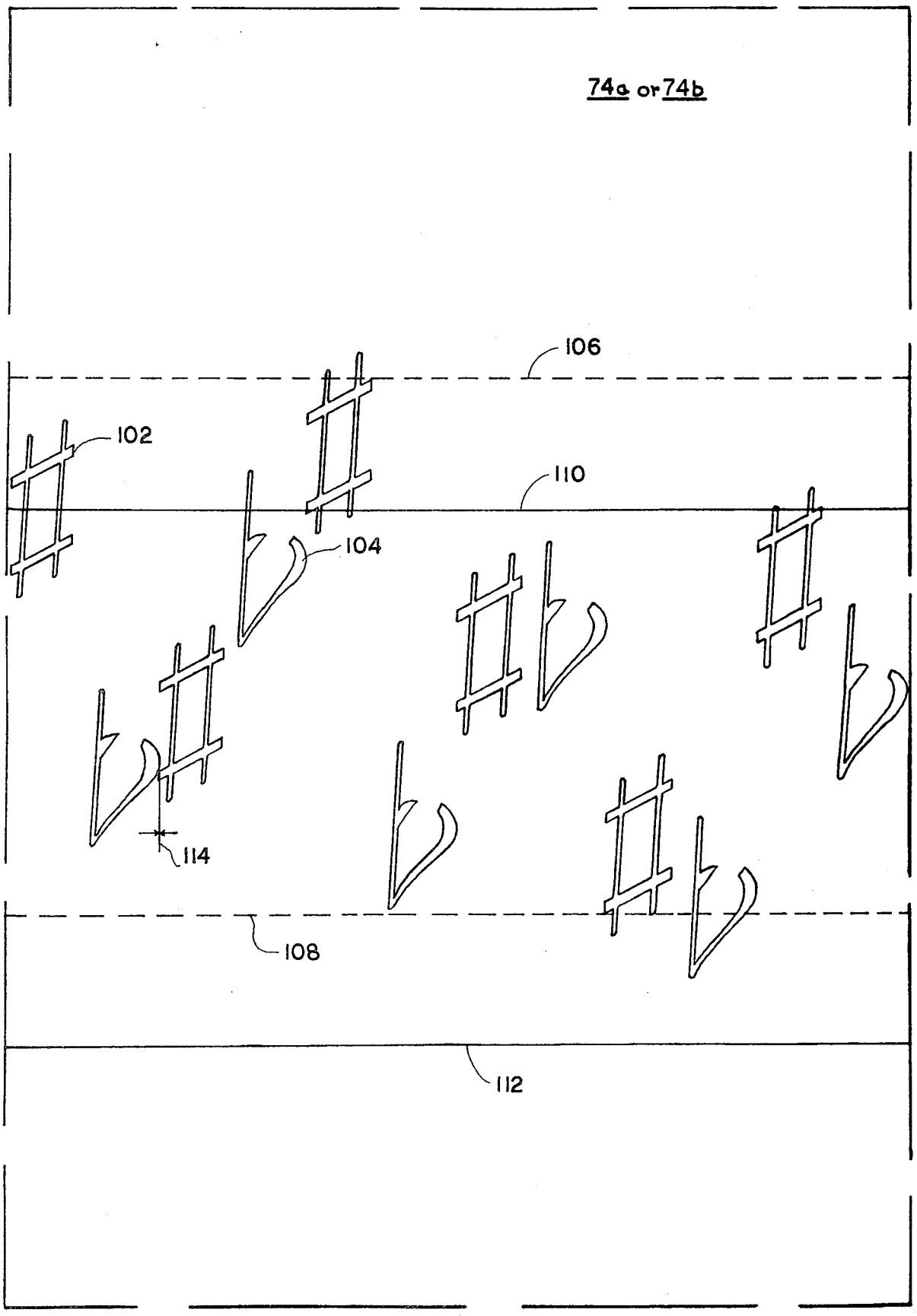
FIG. 4 is an expanded view of the opaque areas of the first overlay involved in setting the desired key signature.

An expanded, detail pattern for the opaque areas, 74*a* and 74*b*, on the first overlay, 52, is shown in FIG. 4. The pattern or spatial relationship of "sharps" and "flats", 102 and 104, is identical for each opaque area, 74*a* and 74*b*. However, the location of the pattern relative to the top and bottom line of the staff is different depending on whether it is the treble or bass clef. The dashed lines, 106 and 108, represent the relative location of top and bottom lines of the bass staff; solid lines, 110 and 112, represent the top and bottom lines of the treble clef. The "lines" do not in fact appear on the opaque area, but are depicted, again, only to illustrate the spatial relationship between the pattern of sharps and flats and either the bass or treble staff.

Also, the opaque area 74*a* or 74*b* represents a portion of the overlay 52. The opaque material is printed or otherwise deposited on the transparent material comprising the overlay 52. Further, the pattern of sharps or flats are etched in the opaque area or otherwise formed during the printing step, thus creating "windows" through which can be seen the appropriate key signature notations on the sheet 54. This aspect will be described hereinafter.

The up-down pattern of sharps or flats and the distances there between, primarily vertical, take into account the spacing between the staff lines 66 and the standard method of depicting the sharp or flat key signatures.

Figure 5:
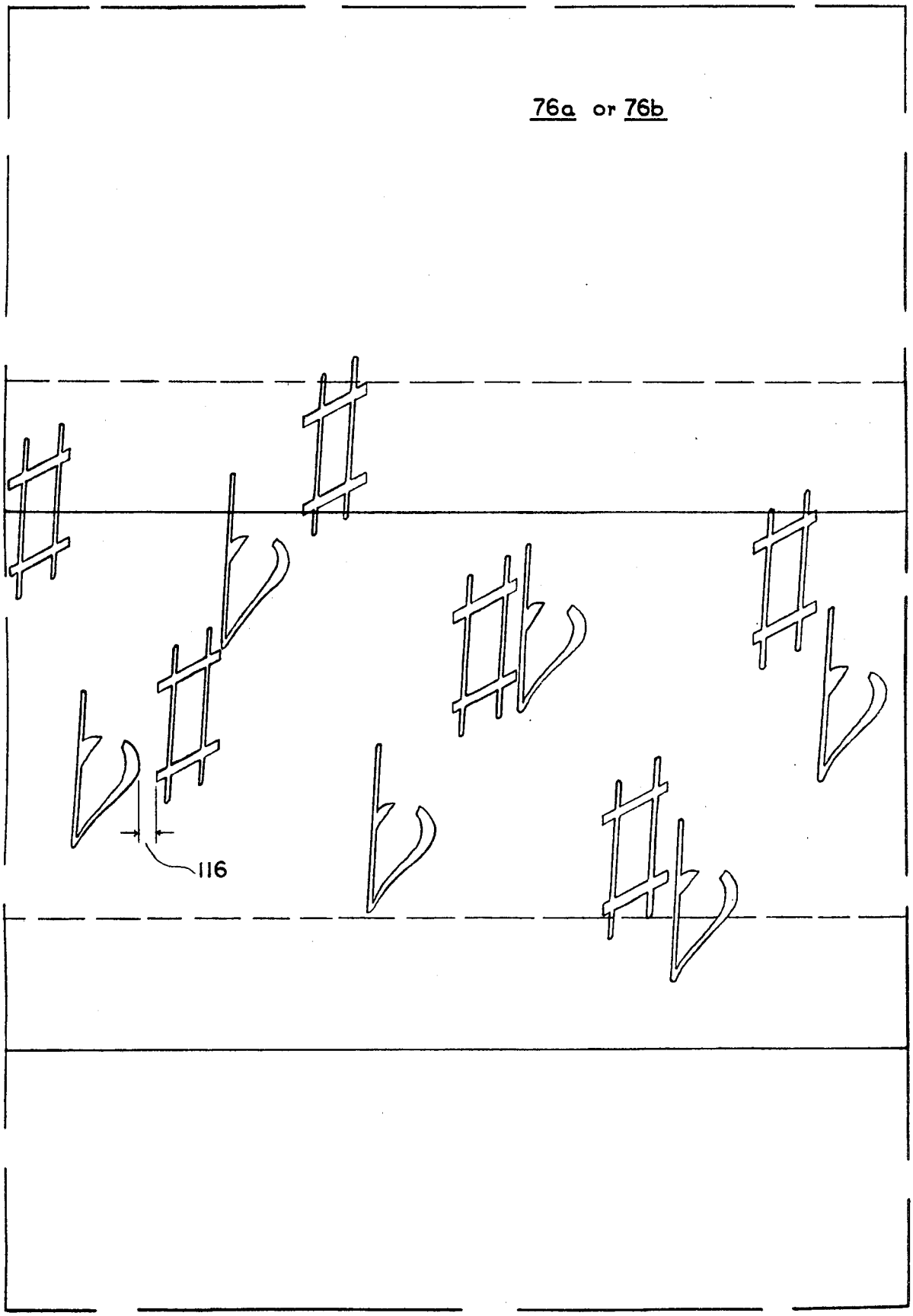
FIG. 5 is an expanded view of the opaque areas of the second overlay involved in setting the desired key signature.

FIG. 5 represents the boxed areas 76*a* or 76*b* on the second overlay 56. Again, the opaque area with its pattern of sharps and flats is formed as above; with the dashed and solid lines again representing the relative location of the top and bottom lines for the bass and treble staffs, respectively.

Again, the relative location of the windows is precisely formed so that the composite pattern of overlay and opaque sheet representing the key signature reflects the standard notation. Comparing FIGS. 4 and 5, it can be seen that the "horizontal" spacing, such as 114 and 116, and at other places in the pattern, differs. This is due to the fact that part of the alignment procedure for the preferred embodiment (described hereinafter) involves relative sideways movement between the overlay layers 52 and 56 and the opaque sheet 54. This has a different effect on the key signature notation for front and back which is compensated for by the differing, horizontal spacings.

Figure 6:
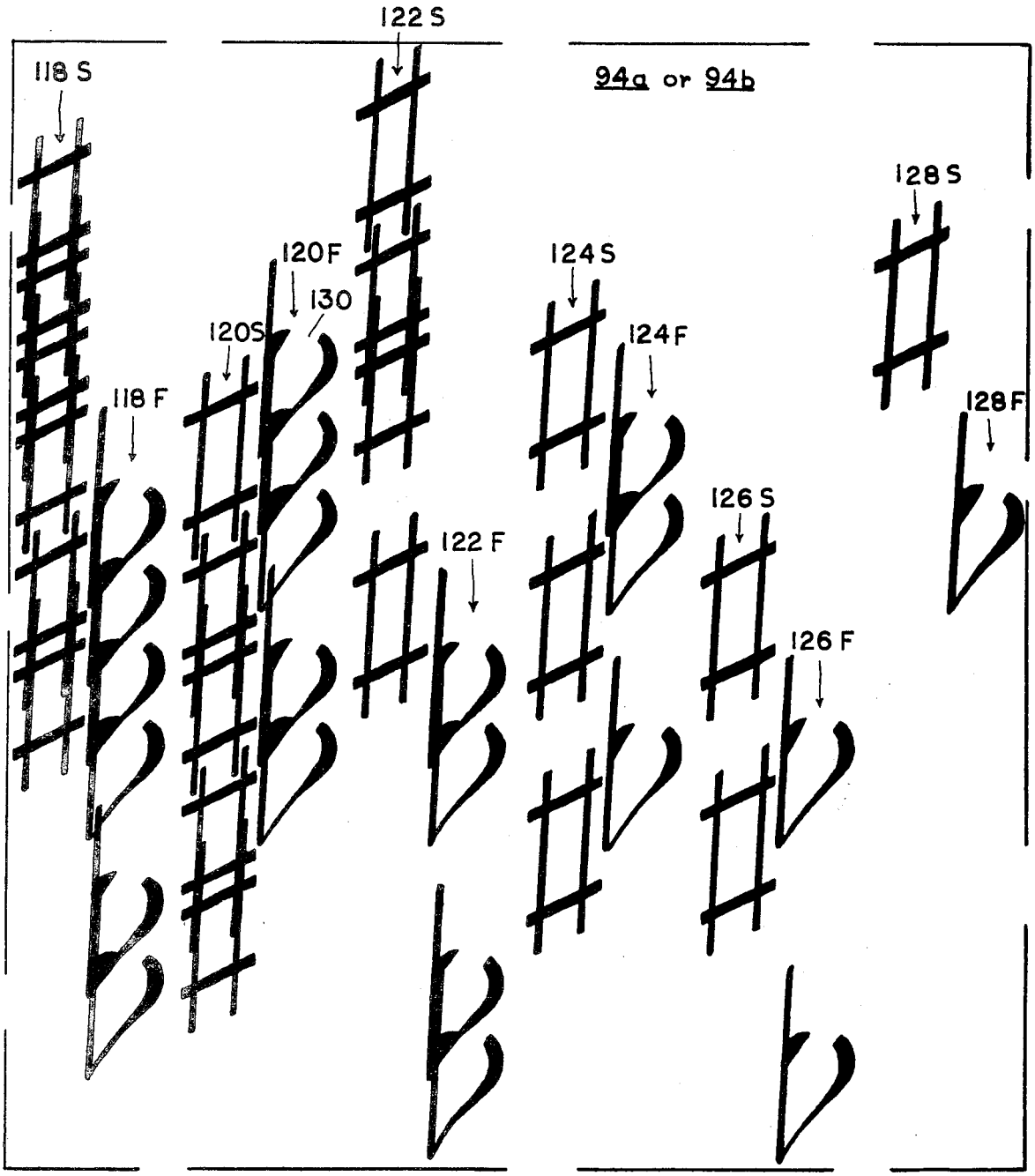
FIG. 6 is an expanded view of the key signature sharps and flats on the obverse side of the opaque sheet layer.

FIG. 6 is a detail view of the key signature areas 94*a* and 94*b* on the opaque sheet 54. The notations comprise six columns of sharps and flats, labelled 118, 120, 122, 124, 126, 128, "s" or "f", respectively. Column 118 has six notations, while column 128 has but one. The intervening columns, from 118 to 128, have a descending number of signature notations, whether sharps or flats.

The vertical and horizontal spacing of the signature notations is developed, in order that, after aligning for the desired key, the composite comprising the overlap of opaque areas 74*a* or 74*b* on the first overlay 52 with the key signature areas, 94*a* or 94*b*, results in the appropriate number of, and staff location for, the sharps or flats.

Each flat notation includes a discontinuous section 130. This avoids an excessive showing of flat symbols which are to be obscured for the particular key. This can be better understood from FIG. 7.

Figure 7:
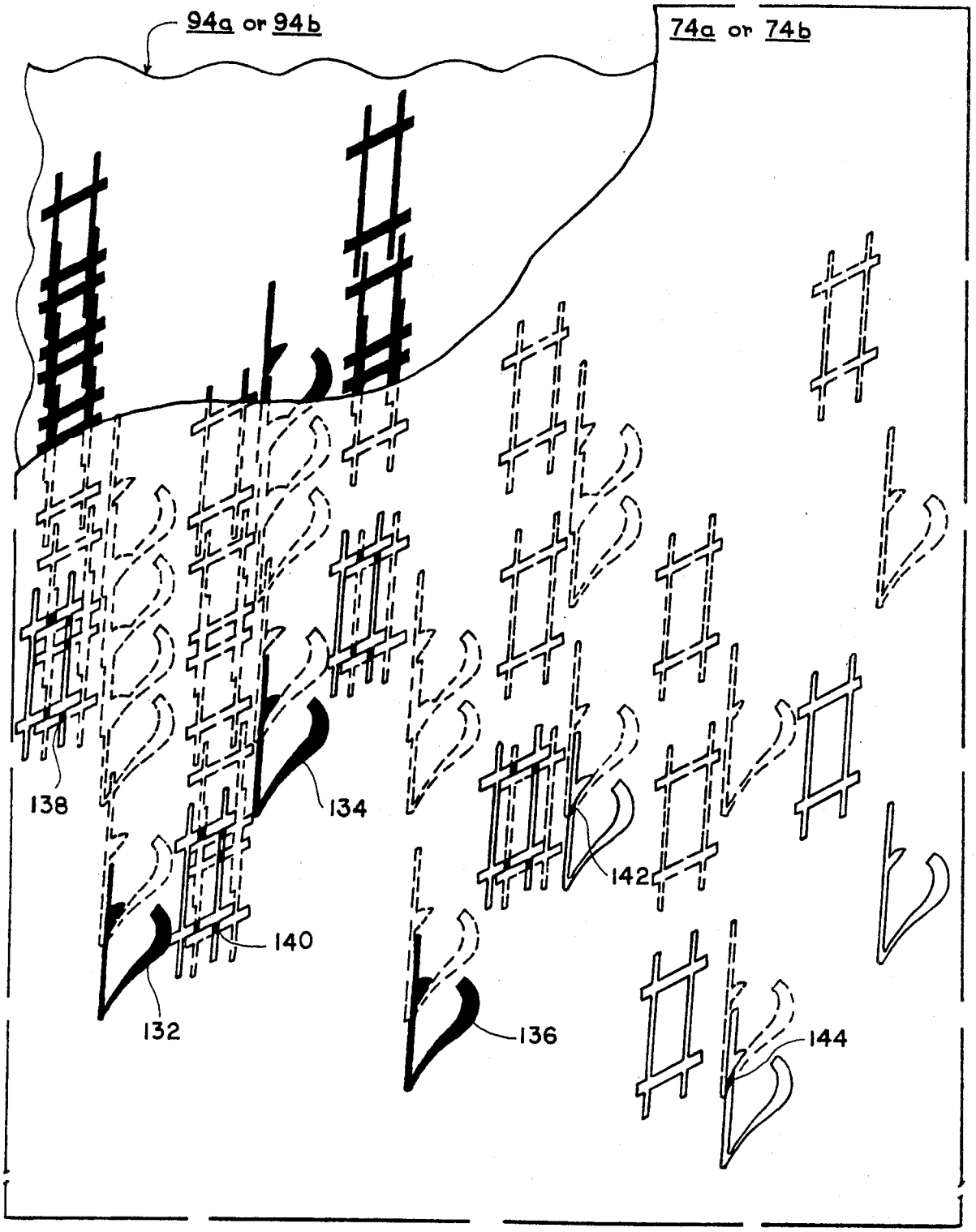
FIG. 7 shows the first overlay key signature opaque area of FIG. 4 superimposed on sharps and flats of FIG. 6 with part of the opaque area sectioned away. The key of E-flat is shown.

FIG. 7 shows the first overlay, key signature opaque area 74*a* or 74*b* (see FIG. 4), superimposed over the sharps and flats of areas 94*a* or 94*b* (FIG. 6). Part of the opaque portion is broken away to reveal the key signature areas on the opaque sheet. The figure shows the overlay and opaque sheet aligned for the key of E-flat. If the staff lines were shown (eliminated here for clarity purposes), flats 132, 134 and 136 would appear in appropriate location for that key in relationship to them. (Refer to FIG. 1 to see the relationship of the flats in the key of E-flat to the staff line for the treble and bass clef).

From this drawing the cooperative relationship between areas 74 and 94 is best appreciated. Portions of unneeded sharp or flat notations can be seen appearing through the windows of the opaque portion—for example, at reference points 138, 140, 142 and 144. This distraction has been found to be of minor consequence in the appearance of the key signature as observed by the musician.

Figure 8:
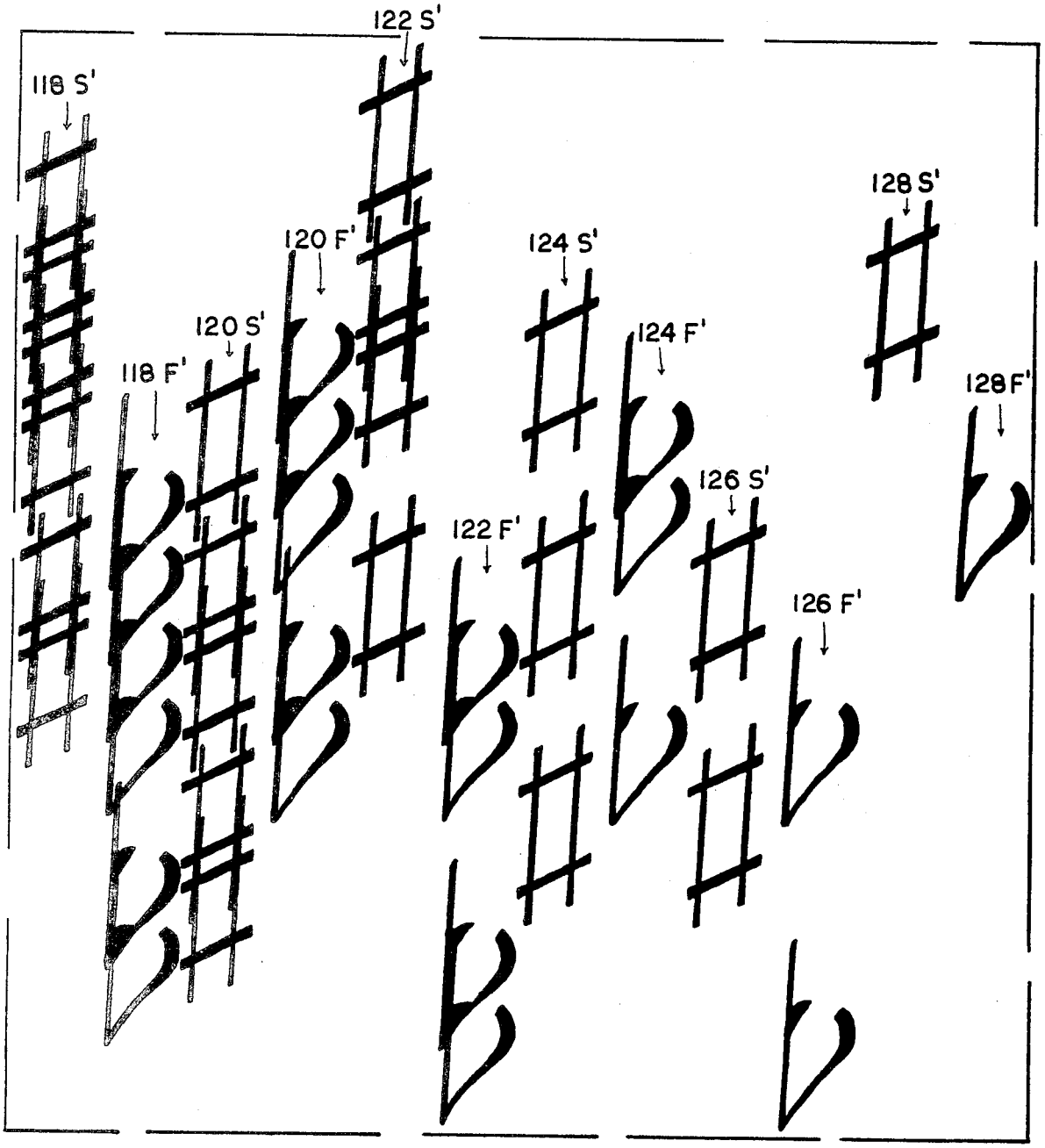
FIG. 8 is an expanded view of the key signature sharps and flats on the reverse side of the opaque sheet.

FIG. 8 shows the key signature notations on the reverse side of opaque sheet 54. The columns of sharps and flats have been primed to distinguish them from those depicted in FIG. 6. The horizontal spacing between the columns differs from that occurring with respect to FIG. 6. Again, as with the spacing between the "windows" on the opaque areas (see FIGS. 4 and 5), this is done for this embodiment to compensate for the difference in direction during alignment of relative movement between the opaque sheet 54 and the respective overlay 52 or 56.

Figure 9:
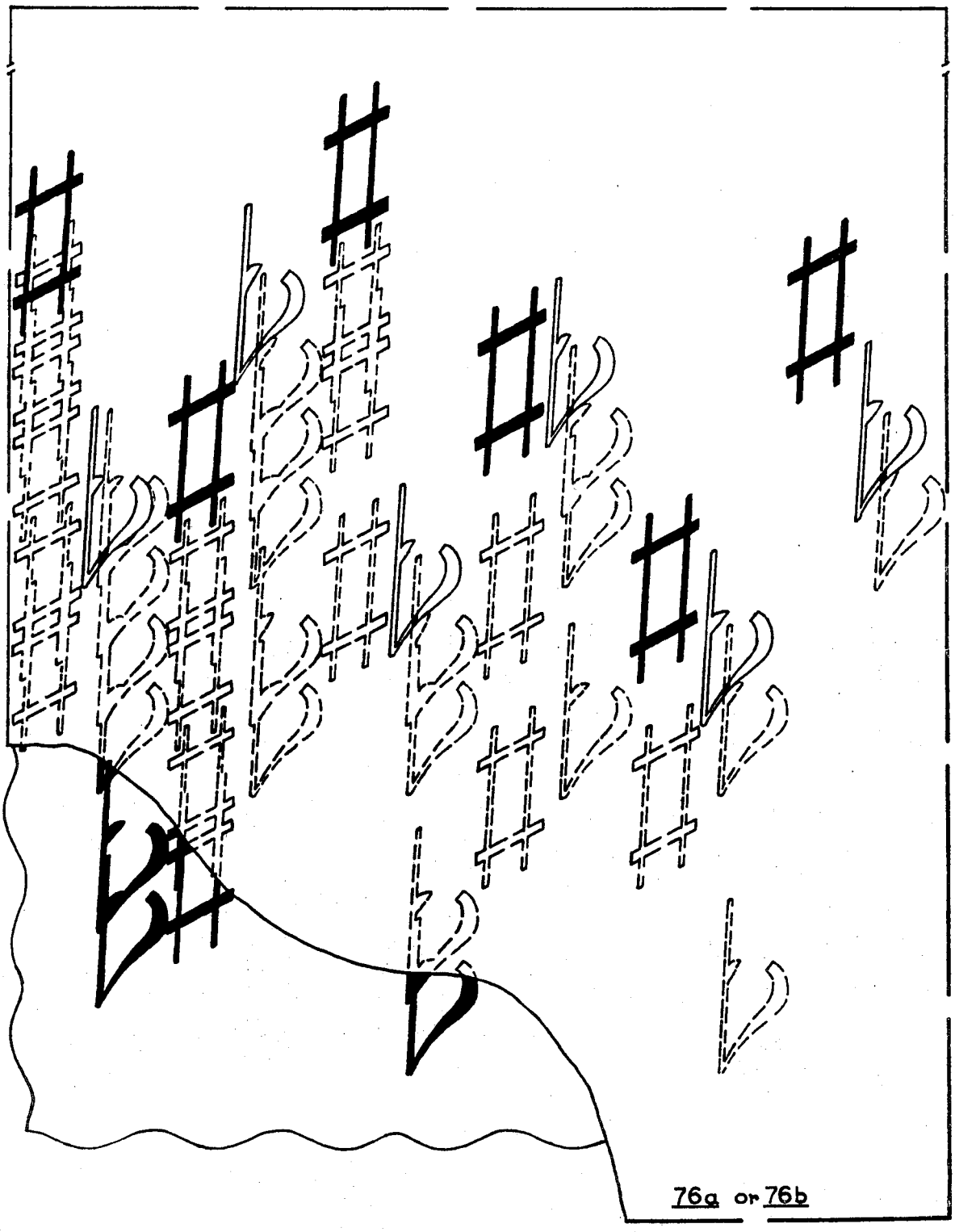
FIG. 9 shows the second overlay key signature opaque area of FIG. 5 superimposed on sharps and flats of FIG. 8 with part of the opaque area cut away. The key of F-sharp is shown.

FIG. 9 depicts the second overlay, key signature opaque area 76*a* or 76*b* (see FIG. 5), superimposed over the sharps and flats, of the complementing notation areas on the reverse side of the opaque sheet 54. The key illustrated is F-sharp, which has a six sharp key signature. As before, the alignment of the sheet 54 in relation to the overlays would be such that the six sharps would be in the necessary location relative to the staff lines (again, not shown), to properly represent the desired key.

Figure 10:
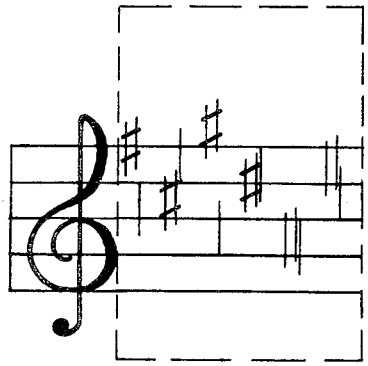
FIG. 10 is a view of an alternate means for implementing the key signature.

Referring now to FIGS. 10 through 14, there is depicted another embodiment which can be employed with respect to the key signature area. FIG. 10 shows the composite of overlay with opaque sheet in the way it would present itself to the musician.

Figure 11:
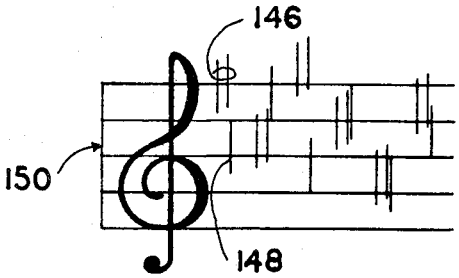
FIG. 11 is a view of one printing on the overlay sheet necessary to implement the embodiment of FIG. 10.
Figure 12:
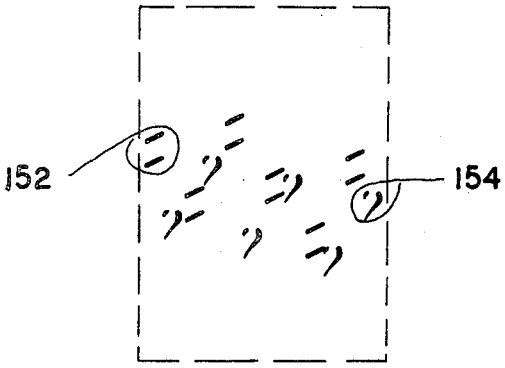
FIG. 12 is a view of the opaque area that would be printed on the overlay of the embodiment of FIG. 10, in another printing, with the window areas shown darkened for clarity purposes only.

FIGS. 11 and 12 reflect the appearance of the transparent overlay after successive printings thereon. FIG. 11 shows the first printing step which includes vertical lines such as 146 which are part of the sharps in this embodiment; and line 148 which represents the stem of one of the six possible flats. These lines are disposed on the staff 150 at the standard locations. There are six sets of vertical lines for the possible locations for sharp, key signatures, as well as six independent vertical lines for the corresponding locations for flat, key signatures.

FIG. 12 depicts the second printing applied to the transparent overlay. It includes windows such as 152 for the cross members of the sharps, and windows such as 154 for the body portion of the flat notation. The second printing is actually in an ink, again, identical as closely as possible to the color of the opaque sheet. The "black" lines shown in the drawing, are, in fact, transparent windows which are shown as such only for purposes of illustrating the shape and relative location of these windows. Again, there are six sets of cross hatch marks, one set for each possible sharp; and, six windows, each representing one of the potential flats.

Figure 13:
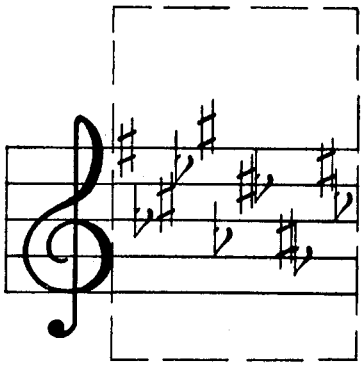
FIG. 13 is a view of the two printings on the overlay, shown in FIG. 11 and FIG. 12, showing their registry and composite effect.

FIG. 13 is an attempt to represent in a black and white drawing, the composite resulting from the printings depicted in FIGS. 11 and 12. Again, the cross hatch or cross members of the sharps and the body portions of the flats are, in fact, actually windows which would be transparent. These are shown blackened in FIG. 13 for purposes of clarity in understanding the successive printing steps.

Figure 14:
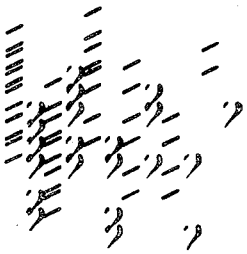
FIG. 14 is a view of the printing on the underlying opaque sheet of the embodiment of FIG. 10.

FIG. 14 shows the key signature printing which is done to the opaque sheet for the embodiment described in FIGS. 10 through 14. Because the vertical lines have been transposed to the overlay, there are no such lines in this figure, as was the case in the first embodiment.

The combination of the opaque sheet with the corresponding key signature opaque area on the overlay results in a composite presentment to the musician. FIG. 10 shows the actual appearance of the key signature notation for the key of E. The extraneous vertical lines would be ignored by the musician as surplusage in view of the particular key selected. In FIG. 10 the window members shown in FIG. 12 are in place, but due to the fact that, for the particular key, there is no alignment of the cross hatch members of the remaining sharps and the body portion of the flats with corresponding notations on the opaque sheet (as depicted in FIG. 14), they generally will not appear to the musician.

Referring now to FIGS. 15 through 20, there is illustrated another aspect of the present invention. The chord guide technique disclosed facilitates the correlation of the various chords which are to be played at points in the music score. The actual chords struck will depend on the key that is selected so that the arrangement to be described involves a corresponding alignment between printed notations on the opaque sheet 54, and the first or second overlays.

Referring back to FIG. 1 at this point, the chord guide depicted in FIGS. 15 and 16 would be located typically below the title of the musical piece in the area designated 156. The location at this point on the page and the three-row arrangement, as shown in FIG. 16, is relatively arbitrary. Typically, adequate room is available below the title and the inventor herein utilizes that fact for placement of his chord guide. The second and successive pages of the music score normally have the staff lines placed closer to the top of the page. To accommodate the reduced spacing, the inventor herein utilizes the modified chord guide as partially depicted in FIGS. 18 and 19. The latter represent the middle portion of the guide of FIG. 15. Corresponding modified sections equivalent to the top and bottom sections of FIG. 15, would be placed on either side of the section depicted in FIG. 18, on page 2 and the successive pages. The modified format will be described hereinafter.

Again referring to FIG. 1, the music score sets forth the necessary chords to be struck for the particular key indicated, E-flat, above each measure. For example, the first three successive chords depicted are I, VI-dim. and II-m. "Dim" and "m" imply a "diminish" or "minor," terms well known to the musician.

The Roman numerals indicate one way of designating chords and happens to be the method preferred by many music teachers and arrangers. It often appears in teachers' copies of song books. However, the alternate system utilizing the letters A, B, C, D, E, F and G are perhaps more familiar. The guide aspect of the invention thus provides the musician not familiar with the Roman numeral scheme with a technique which will allow him to select the appropriate chord by just glancing to the top of the page for the corresponding, perhaps better recognized, designation therefor.

The advantage of the Roman numeral system is that it remains constant regardless of the particular key selected. The letter designation for the chords, however, vary with the key selected. The advanced musician is already quite familiar with the chord to be struck as designated by the Roman numeral in view of the key selected. FIGS. 15 through 20 illustrate a way in facilitating the conversion for the less experienced musician.

Figure 15:
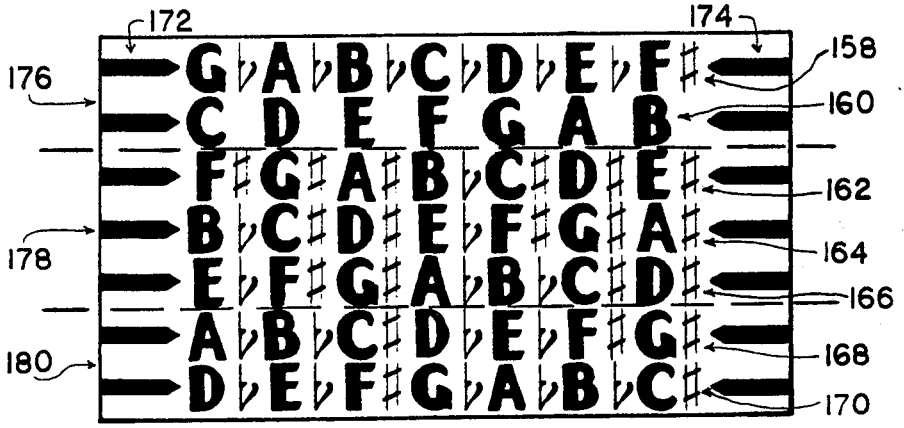
FIG. 15 is an enlarged detail view of the chord symbol guide on the front of the opaque sheet of the invention.
Figure 16:
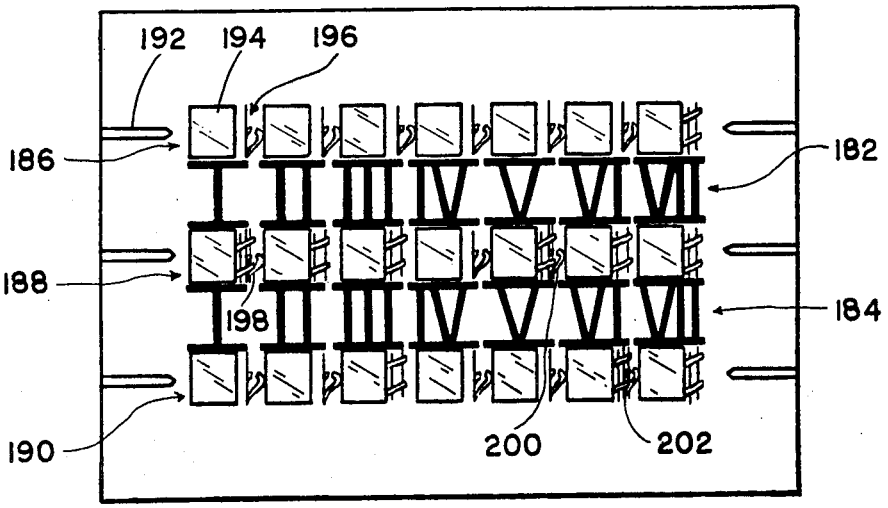
FIG. 16 is an enlarged detail view of the chord symbol guide opaque grid on the first overlay.

FIG. 15 depicts the printing that is made on the opaque sheet 54 in the area 92. It includes seven rows of letters, 158, 160, 162, 164, 166, 168 and 170. Also included are at least, one column of indicating arrows 172. A second column of arrows 174 may be disposed along the opposite edge of the printed area. These are aligned substantially with the midline of each row of letters.

The guide can be considered to comprise three sections, 176, 178 and 180. Top and bottom sections 176 and 180 include two rows of chord letter symbols, while the middle portion 178 has three such rows.

Each row in each section comprises a series of letter notations with an appropriate sharp or flat notation disposed along the side of each letter. It will be noted that the second row in the top section, row 160, does not include a corresponding sharp or flat notation with the letters. Musicians would recognize that this corresponds to the key of C. The sharps or flats, together with the letter symbol, are ordered in each row in a predetermined fashion to achieve the necessary correspondence between the letter chord designations and the Roman numeral designations.

FIG. 16 depicts the final appearance on the transparent overlay sheet 52 in the area corresponding to that designated as 156 in FIG. 1. Successive printings are employed to develop the composite picture shown. The first printing disposes the two rows of Roman numerals, 182 and 184, in predetermined locations. Thereafter, the successive printing of the overlay deposits the opaque material which, again, is close in color to the opaque sheet 54. The three rows of windows, 186, 188 and 190, are disposed in predetermined registry with the Roman numerals, etc.

Figure 17:
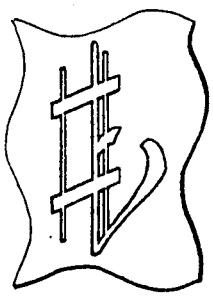
FIG. 17 is an expanded view of one sharp/flat opening in the opaque area of FIG. 16.

Each row of windows includes at least one, indicating arrow window 192; seven box-like openings 194; and 7 sharp and/or flat-like openings, for example, 196, as determined in conjunction with the development of the guide portion on the opaque sheet (see FIG. 15). Three windows, 198, 200 and 202, are designed to allow the display of a sharp or flat depending on the key selected. These involve the keys of F sharp and B flat which have an alternate designation of a sharp or flat depending on the key selected. An expanded view of this portion of the overlay is depicted in FIG. 17. Also, this figure shows the general shape of the sharps and flats utilized in the invention.

As noted above, FIG. 18 represents the middle section 178 of the chord guide disposed on the reverse side of the opaque sheet.

Figure 18:
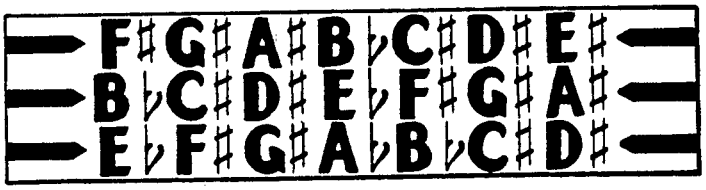
FIG. 18 is an enlarged detailed view of one of the chord symbol guides on the back of the opaque sheet.
Figure 19:
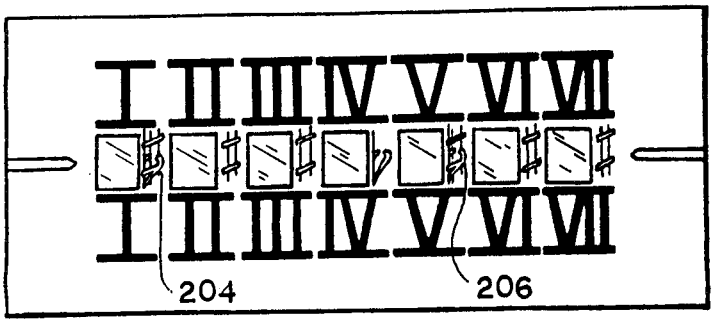
FIG. 19 is an enlarged detail view of one of the chord symbol guide grids on the second overlay.
Figure 20:
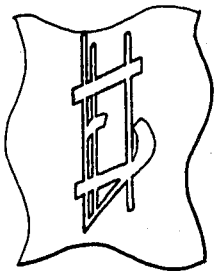
FIG. 20 is an expanded view of one sharp/flat opening in the opaque area of FIG. 19.

FIG. 19 depicts the row 188 of the overlay portion appearing in FIG. 16, again, as modified for use on the second overlay which cooperates with the reverse side of the opaque sheet. Segments corresponding to the top and bottom sections 176 and 180 and rows 186 and 190 would be disposed on either side of the sections depicted in FIGS. 18 and 19 to provide the full chord guide on the reverse side. The one difference as to the guides used on the back side, as depicted in FIGS. 18 and 19, reflect the same consideration described above with regard to the placement of the sharps and flats, i.e., compensation for the relative horizontal movement between the front and back. Thus, a careful study of the relative, side by side relationship between the sharp and flat windows and the box windows in FIG. 16, show, in this illustration, that they are closer to the box window openings than the corresponding arrangement in FIG. 19. Again, this is due to the difference in direction of the relative movement between the opaque sheet and the first overlay, as opposed to the second overlay.

Also, modified sharp-flat notations 204 and 206 corresponding to 198 and 200 are employed. These, likewise, reflect the difference in direction of relative movement between the opaque sheet and the first or second overlay (see FIG. 20 for an expanded view of these particular symbols and note the difference in lateral relationship between the flat and the sharp).

The chord guide is configured with predetermined dimensions which result in the display of the right chord letter corresponding to the Roman numerals for the particular key selected. Once chosen and the opaque sheet aligned with the first overlay, in the manner to be described hereinafter, a corresponding arrow member from column 172 would appear in the indicating arrow window opposite one of the rows of windows 186, 188 and 190. The particular row in which the indicated arrow appeared would reflect the letter symbols corresponding to the Roman numeral designations set out in the music score.

Likewise, on the back side of the composite, including the reverse side of the opaque sheet 54 and the second overlay 56, a corresponding alignment would occur so that the chord letter symbols disposed under respective Roman numerals would be identical to that displayed on the front side of the composite. Obviously, there is necessary registry between the chord guide symbol and the alignment means for key selection which will be more apparent from the discussion of the latter hereinafter.

When a particular indicating arrow is aligned with the space or opening such as 192, for example, that row of windows will be showing the proper letter symbols. The other rows of windows, because of the spacing between the rows 158, 160, etc., will only show fragments of letters. This will minimize any confusion which might result by temporary eye movements by the musician.

Figure 21:
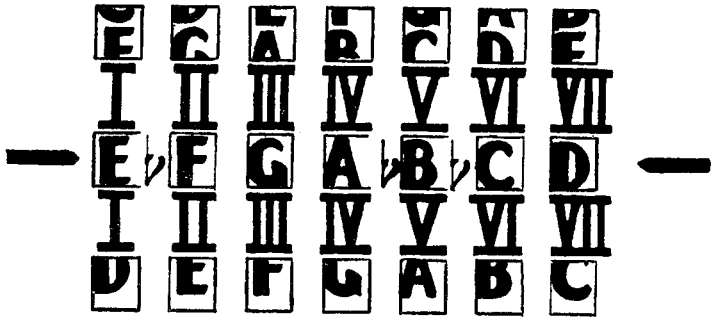
FIGS. 21, 22, 23 and 24 show the composite appearance of the chord guide symbol means for both the obverse and reverse sides of the system of FIG. 1.

The composite effect of the chord guide is depicted in FIGS. 21 to 24. FIG. 21 shows the key of E-flat as it is displayed on the obverse side while FIG. 23 reflects its appearance on the reverse side. It can be seen how the aligning arrows would readily focus the musician's eyes on the letter chord equivalents of the Roman numeral system; and how only partially viewable letters appear in the other rows of windows, thus avoiding selection of an inappropriate chord.

Figure 22:
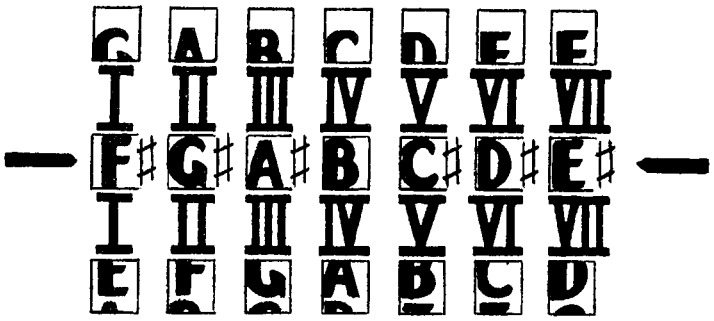
Figure 23:
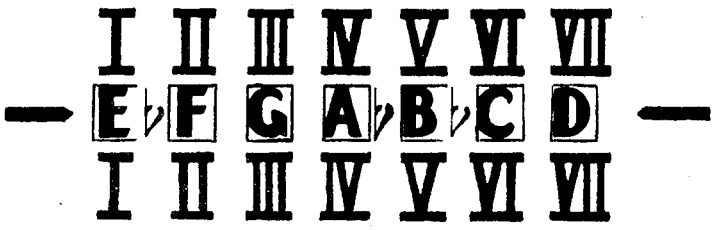
Figure 24:
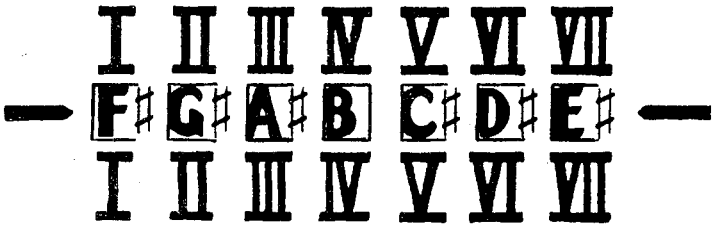
Figure 25:
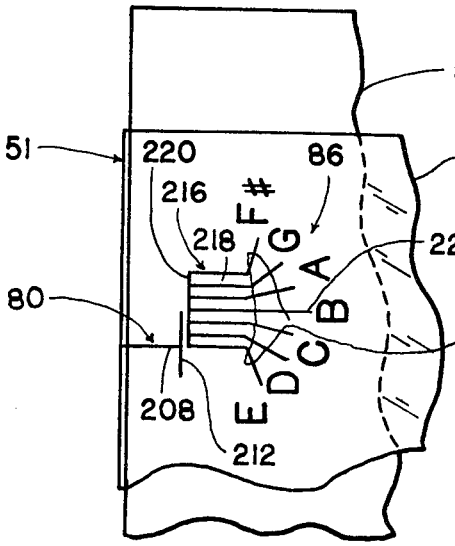
FIGS. 25, 26, 27 and 28 are detail views of one embodiment of the key setting aspect of the present invention.
Figure 26:
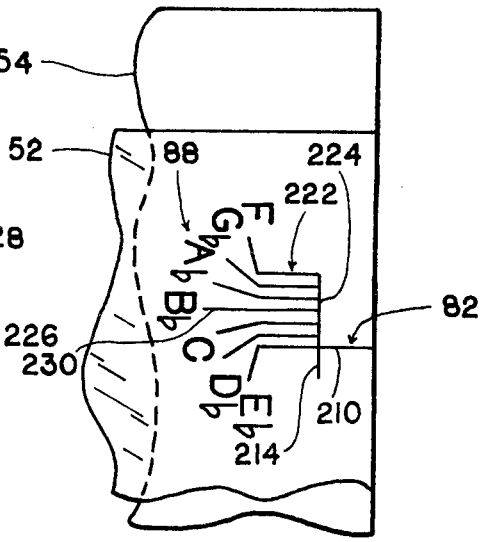

FIGS. 22 and 24 show the selection of F-sharp and how the chord guide would appear on the front and reverse sides, respectively.

Refer now to FIGS. 25 through 28. These depict a means for aligning the opaque sheet 54 and the overlay envelope 51. Such aligning means would typically appear on each odd-numbered, composite page of the music score. This is so in the case where there is a single opaque sheet printed on front and back. The alignment of the odd-numbered or front sheet automatically results in the alignment of the back side of the opaque sheet with its corresponding overlay.

FIGS. 25 through 28 are expanded views of the uppermost corner sections of the opaque sheet 54 and the envelope 51. The latter includes a first overlay 52 which, in fact, works in conjunction with the opaque sheet 54 to achieve the necessary alignment. The reference numerals utilized in these figures correspond to the like-numbered parts depicted in FIGS. 1, 2 and 3. They will be used throughout the balance of this discussion.

Summarizing the previously stated construction of the present invention, the opaque sheet 54 is disposed between the first and second overlays 52 and 56 which comprise the envelope 51. The overlays are substantially transparent with various printed, so called, stationary notations disposed thereon. The opaque sheet 54 includes printed notations which may be characterized as mobile. A further discussion of this will occur hereinafter.

Figure 27:
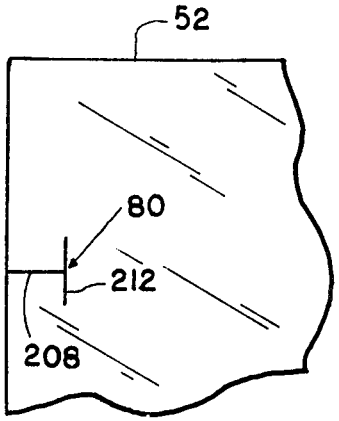
Figure 28:
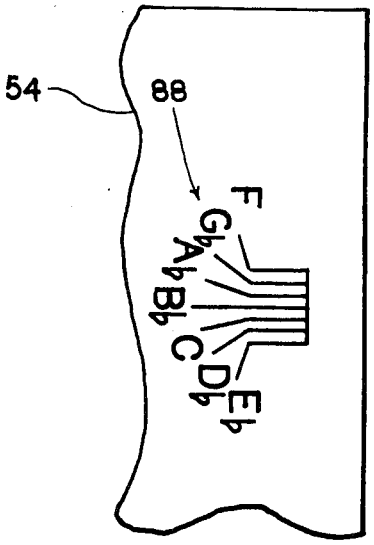

For the purposes of this aspect of the invention, one of the printed notations on the first overlay 52 is the T-shaped characters 80 and 82 disposed respectively at the left-hand and right-hand edges of the overlay. FIG. 27 illustrates the relationship of the T-shaped notation 80 to the left-hand edge of first overlay 52. Each includes a horizontal line 208 and 210 each parallel to the staff lines 66, which begins at the respective edge and terminates a slight distance therefrom at vertical lines 212 and 214. The latter vertical lines may be printed as shown or be opaque.

Opaque sheet 54 insofar as this aspect of the invention is concerned includes two groupings of key registry notations 86 and 88. All possible musical keys are covered by either one of the two groupings. In fact, one is the mirror image of the other except for the sharp or flat placement. Note that the key of C is identically designated and located in each grouping since it has no sharps or flats.

Each grouping comprises a series of substantially horizontal lines. At one end, 216 for example, the lines are seen to be horizontal and thus parallel to each other. The spacing between each pair, 218 for example, is equal to one half the spacing between the staff lines 66 (see FIG. 2). The end of each grouping nearest the edge of the overlay terminates in a vertical line 220 or 224. The opposite end, 226 for example, in grouping 86, spans out from the horizontal lines and terminates in the key letter designation as depicted in the drawing. For accuracy of alignment, it is desirable, but not absolutely critical, that the thickness of the lines 208, 210, 212 and 214 be of the same thickness as the lines forming the horizontal portion of the key signature groups and the vertical lines in which the ends terminate.

A study of the groupings shows that the key of B or B-flat is disposed in the respective centers of the groupings along center lines 228 and 230. The remaining keys are distributed on either side thereof in the successive order recognized by musicians as representing half or whole step changes up or down from the next preceding key.

When the musician desires to adjust the composite to reflect a certain key, he moves the opaque sheet 54 relative to the overlay envelope 51. He does this until either the vertical line 212 or 214 of the corresponding T member aligns with the vertical line 220 or 224 of the group containing the particular key desired. He also adjusts the vertical relationship between the sheet and the overlay 54 until the horizontal line 208 or 210 is disposed substantially in line with the horizontal line in the respective grouping 86 or 88 which terminates in the desired key. A study of FIGS. 25 and 26, for example, show that the particular key selected in the key of E-flat. Where the vertical "lines", 212 and 214, are opaque, and thus "block out" lines 220 or 224, the accuracy of alignment is further enhanced.

Once the alignment from the sheet to the overlay is effected, the various sharps or flats representing the key signature appear through the windows of the overlay in area 74 so that the composite impression to the musician is the exact signature for the selected key. Also, the chord guide is automatically set so that for the embodiment described above, the letter designations for the Roman numeral indications are set forth in the windows of the opaque area at the top of the page.

Also, by aligning the opaque sheet with the first overlay the alignment of the printing on the back side of the opaque sheet with the second overlay is automatically effected. Of course, the remaining musical notations on the opaque sheet, i.e., notes, incidental notations, slurs, tie lines, and others, assume the necessary relationship to the staff lines 66 based on the key selected. The details of this latter relationship will be discussed with respect to the succeeding drawings.

The snugness of fit between the opaque sheet and the envelope comprising the first and second overlays assures the retention of the relative position between the two so that there is no slippage during the performance of the score. If it is desired to further assure the fixed relationship, a simple expedient such as a paper clip can be applied to insure necessary pressure.

Referring now to FIGS. 29, 30, 31 and 32, the invention can be discussed from the point of view of the composite effect that the shifting of the opaque sheet relative to the transparent envelope has insofar as the appearance of the music score to the musician.

Figure 29:
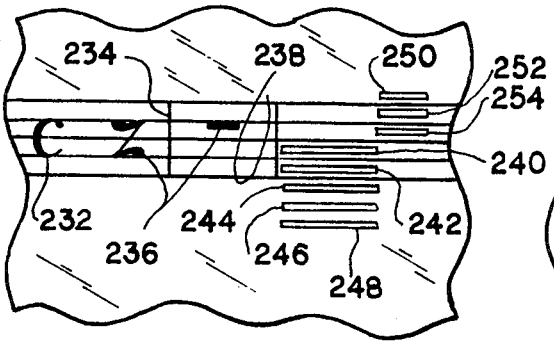
FIGS. 29, 30, 31 and 32 are various sectional views utilized to demonstrate the cooperative relationship between the notations on the opaque sheet and overlays for two different key settings.
Figure 30:
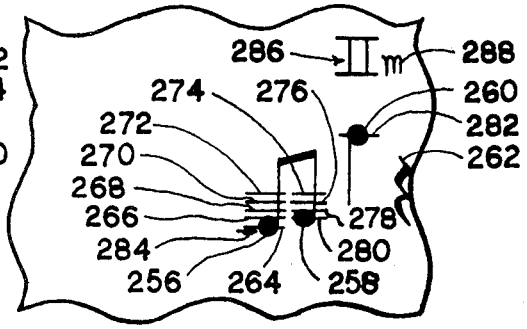
Figure 31:
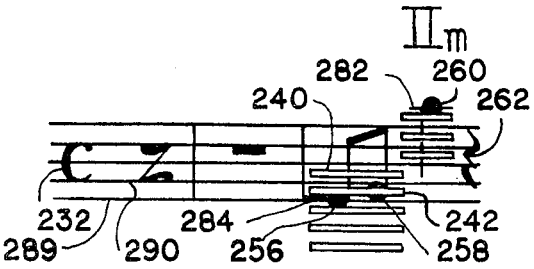
Figure 32:
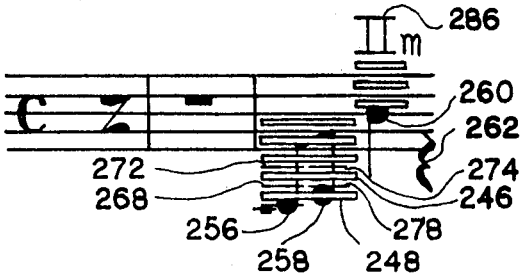

FIGS. 29 and 30 show, respectively, in detail, the printings which are disposed on the overlay sheets, such as 52 and 56, and the printing on the opaque sheet 54. Only a portion of each are shown. FIGS. 31 and 32 show the composite relationship between FIGS. 29 and 30 for two different key signatures. FIG. 31 reflects the position of the opaque sheet in its uppermost position in relation to the transparent overlay; while FIG. 32 reflects the lower-most position. Further, if the key signature represented in FIG. 32 is, for example, E-flat, the key represented by the composite of FIG. 32 is F-sharp. This is so because in addition to the vertical movement apparent between the two figures, a careful observation will reveal that there is also a horizontal movement of the opaque sheet to the left in FIG. 32 from its position in FIG. 31 (compare the horizontal position of the note above the staff lines in FIG. 31 and its location in FIG. 32 on the third staff line).

Again, FIG. 29 represents a portion of a transparent overlay such as 52. In this drawing the portion of the transparent overlay involving the key signature or the chord guide discussed above is not depicted. What is seen is that which might be referred to as static music notation; and, also, opaque areas in the form of lines. One point about the "opaque lines" is that for purposes of the drawing only, they are shown bordered by black lines. It is to be appreciated that in fact the overlay is transparent and the appearance of such opaque areas to the musician would not, in fact, include a black bordered area. Also, it is to be understood that the line width of the opaque areas that is depicted in the figure is greater than it normally is in practice. This, again, is due to the limitations of trying to depict such areas on a drawing. The opaque lines are, in fact, just thick enough to obliterate the unneeded, supplementary staff lines.

Again, the music notations which are printed on the overlay are those which might be referred to as static notations. These would include, for example, the time signature 232, measure bars 234, rests 236, full staff lines 238. In addition, the opaque line areas 240, 242, 244, 246, 248, 250, 252 and 254 are likewise printed on the overlay, during an additional printing. The opaque line areas, as with the other opaque areas, has a color appearance as closely as possible to the color of the opaque sheet.

The spacing between successive opaque lines is substantially equal to the spacing between two successive staff lines in the group 238. Again, the width of the lines, that is the opaque lines, is sufficient to obliterate the staff lines which would appear above or below the main grouping 238 as printed on the opaque sheet.

FIG. 30 shows a portion of the opaque sheet 54. Again, the key signature or chord guide areas are not shown here since these were disclosed in detail above. Printed on the opaque sheet are those music notations which can be considered mobile and which are unique to a particular piece of music. These include the notes 256, 258 and 260; rests 262 which move with the notes; staff lines 264, 266, 268, 270, 272, 274, 276, 278, 280 and 282 which would appear above or below the staff line grouping 238. The spacing between two successive, supplementary staff lines, such as 266 and 268, would be substantially equal to one-half the distance between successive lines in the main staff group 238. Also included as part of the so-called mobile notations would be augmentation symbols, such as in 284, which accompany a particular note (here, for example 256); particular chord symbols 286 and 288; and other notations not shown, for example, dots or dotted notes, slur and tie lines, triplet notations, etc.

Referring now to FIG. 31, the key depicted would be one at the extreme bottom of the key guide grouping 86 which, for illustrative purposes, will be presumed to be E-flat. Recalling the discussion for FIGS. 29 and 30, notes 256 and 258 are shown positioned on the bottom line 289 and the first space between line 289 and line 290 respectively. As it would appear to the musician, note 260 is positioned one line above the main staff grouping 238. Rest 262 appears on the staff lines where it would normally be located for the selected key. Augmentation symbol 284 appears to be somewhat obliterated. In fact, once again, the opaque lines have only minor effect on the symbol or other notations. A careful study of the composite shows that lines 266 and 280 as they appear on the opaque sheet are obliterated by opaque line 242 on the overlay. Lines 268 and 278 for this particular key fall substantially under line 290 of the main staff grouping so that they are not visible to the musician. Lines 270 and 276 are blocked by opaque area 240 on the overlay.

FIG. 32, as noted above, depicts the opaque sheet moved downward to its lowest position. Also, as described above, there is almost imperceptible but definite movement of the opaque sheet to the left in relationship to the overlay as viewed in FIG. 31. This would result in an alignment of the T member 80 on the overlay with the grouping 86 to identify the key, F-sharp. In this figure notes 256 and 258 are below the main staff grouping. Now 256 is on the third line below the main staff, the first line below comprising lines 272 and 274; and the second a composite of lines 268 and 278. Note 258 is disposed between the third and second lines below the staff. In this particular key, lines 270 and 276 on the opaque sheet are obliterated by opaque line area 246 on the overlay. Lines 266 and 280 are obliterated by opaque line area 248. Once again, because of the actual, relatively small thickness of the opaque lines, the intrusive effects on notes 256 and 258 are minimal as viewed by the musician.

Note 260 is positioned on the third line of the staff grouping 238. Line 282 on the opaque sheet, in this position, is co-linear with the third line of the staff and, thus, not apparent.

Note the relative location of the chord notation 286 and rest 262 in this particular key.

Of course, given the key signature for the selected key, the musician could readily ascribe to the particular notes the appropriate designations, i.e., sharp, flat or natural, so that the presentation as made by the composite of the overlay and opaque sheet would appear to him substantially identical to how a standard printed sheet of music might have otherwise appeared to him heretofore.

Referring to FIGS. 33 through 41, there is depicted another embodiment of an aspect of the present invention, the key aligning means.

Referring initially to FIGS. 36 through 41, various views depict the special clips 291 and 292 which are employed in this embodiment. Each is generally "L-shaped" and they are made from plastic or other suitable material.

Figure 36:
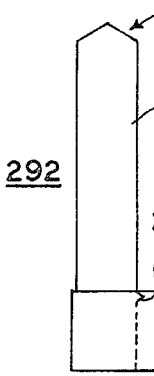
Figure 38:
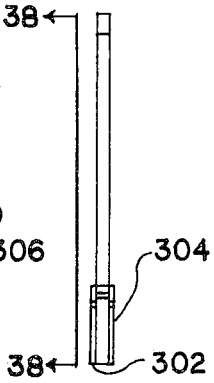
Figure 39:
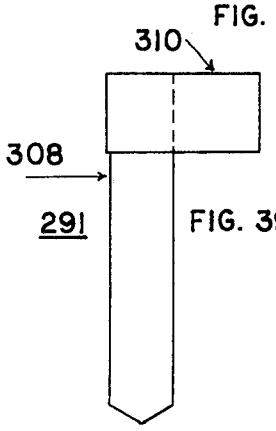
Figure 41:
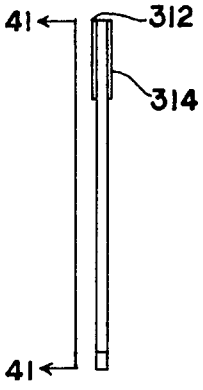
Figure 37:
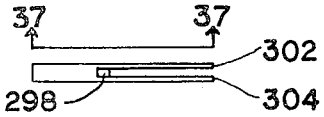
Figure 40:
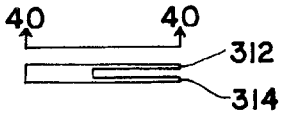

Clip 292 includes an upward extending portion 294 as viewed in FIG. 36 which has an arrow shaped end 296. Further, portion 294 includes a tooth-like projection 298 located near the other end and along its inboard edge.

Transverse to the section 294 is a guide member 300 which comprises two side walls 302 and 304 defining a slot through which passes the opaque sheet in a matter to be described hereinafter. At least one of the side walls includes a registry or viewing slot 306.

The aligning clip 291 again is L-shaped. As viewed in FIG. 39, it includes a downward extending portion 308 and a further transverse portion or guide member 310. The latter includes two side walls 312 and 314, again defining a slot allowing for passage of the opaque sheet as described hereinafter.

Figure 33:
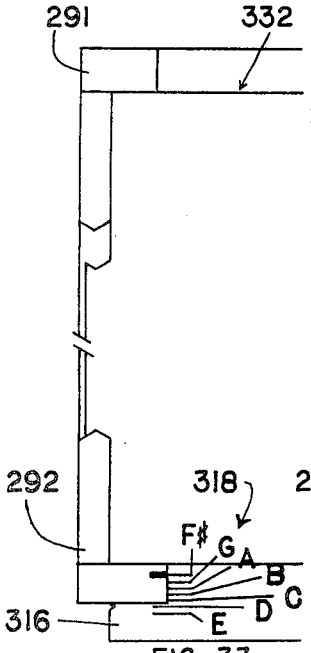
FIGS. 33 through 41 are views of another key setting means that incorporates two corner guides for setting the key and holding the opaque sheet in registry with the overlays.
Figure 34:
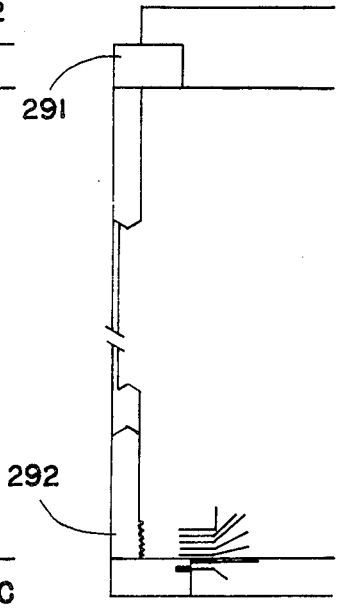
Figure 35:
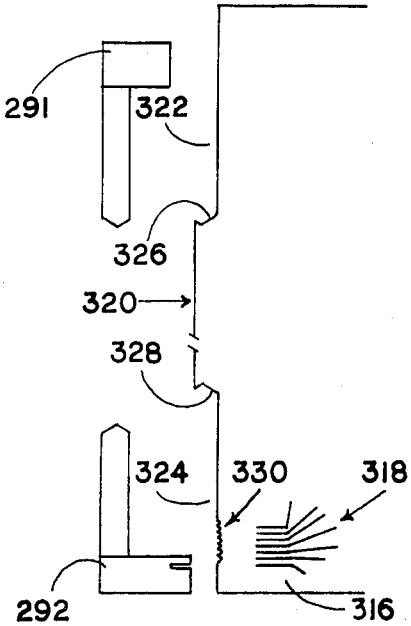

Referring now to FIGS. 33 through 35, for purposes of this embodiment, the opaque sheet 316 includes key aligning notation 318 disposed in a predetermined point at the bottom left-hand corner of the page. This covers seven of the possible key designations. A similar key aligning notation for the remaining key selections appears in the lower right-hand corner of the sheet, but is not shown in the drawing.

Referring to FIG. 35, the opaque sheet 316 is seen to include along edge 320 cutouts, 322 and 324, at both the top and bottom. Each of the cutouts includes an arrow-shaped end 326 and 328 inwardly directed, along the edge. The shape of these ends complements the outline of the ends of clip extending portions 294 and 308.

Further, cutout 324 includes a series of notches 330 which are disposed along the edge in predetermined relationship to the horizontal lines comprising the key aligning notations 318. Again, a similar notch arrangement is disposed along the opposite edge of the opaque sheet for aligning with ragard to the key notations disposed in the right-hand corner. The sheet generally for this embodiment would be made from a heavier material such as that used in making playing cards.

The opaque sheet 316 as before is disposed between the transparent overlay layers comprising an envelope 332 and having the stationary notations associated with a piece of music. The notations on both the overlays and the opaque sheet, except for the differences noted here, are identical in this embodiment as for the previously described one.

Utilization of this arrangement, presuming the composite is set at a particular key, involves removing the top and bottom clips 291 and 292 from the opaque sheet, thus allowing the sheet to be moved between the overlays. The lower clip 292 is moved away from the lower edge of the envelope, a sufficient distance to disengage projection 298 from the corresponding notch, and to allow movement of the sheet. To select another key, presuming it is one of the keys indicated in grouping 318, the lower clip is aligned such that the registry slot 306 is opposite the horizontal line corresponding to that desired key. The clip is then urged onto the sheet such that the latter passes between the side walls 302 and 304, and such that the horizontal line appears through the viewing slot 306. Because of the pre-alignment between the grouping 318 and the notches 330, tooth 298 nests in the appropriate one of the notches in group 330 to thus register the sheet in relationship to the clip 292.

The clip 292 and sheet are then urged upward between the overlays until the top side of the transverse portion 300 contacts the bottom edge of the overlay envelope. At this point the top clip is slipped over the opaque sheet and is brought downward until the bottom edge of the transverse portion 310 contacts the top edge of the overlay envelope. At this time, the music sheets are in proper register for the indicated key and are fixed in relationship to the overlay.

Referring now to FIGS. 42 through 46, there is disclosed yet another embodiment of the aligning means which may be employed to accomplish the purposes of the present invention.

FIG. 42 depicts the first overlay 334 comprising this version. It is transparent except for the printed music notations previously identified, and, as well, the opaque area comprising the corresponding aspect of the aligning means depicted in the drawings. The latter is disposed along both the left and right edges of the overlay and includes apertures 336 for each key. The latter are set at predetermined distances from each edge and are disposed in relationship to each other along the length of the corresponding edge. Rectangular opaque areas 338 extend the length of the edge for approximately the distance between the apertures 336 at the extreme of each key guide.

Registry slits 340 are disposed at the approximate horizontal center line of each aperture and allow for viewing of the opaque sheet behind the overlay. A centering area 342 is provided in the opaque area 338.

FIG. 43 depicts the opaque sheet 344 and, in particular, the corresponding portion thereof which cooperates with the overlay portion to align the music in the desired key. Note the right-hand edge of the opaque sheet is depicted while the left-hand edge of the overlay is shown. Disposed along each edge of the sheet are apertures 346 which are aligned one to the other so as to match up with corresponding apertures such as 336 in the overlay. Extending from the apertures outwardly towards the edge of the sheet are printed line notations 348 which are for registry purposes. The key grouping 350 is disposed on the opaque sheet between the apertures and the edge thereof. They are aligned with the registry lines opposite the particular aperture for that key. A centering dot 352 is disposed halfway along the key grouping so as to cooperate with the centering area 342 during the aligning process.

FIG. 44 shows a button 354 including a body portion 356 and stud member 358.

FIG. 45 is a top plan view of the sheet 344 disposed between the overlays and locked in registry, one to the other, by button 354.

FIGS. 46*a* and 46*b* show the cooperating relationship between the opaque sheet 344 and the left and right edge of the overlay 334. The key groupings for the keys with flats would be disposed along the left edge with the music held in the upright position while the key groupings for the keys with sharps would be disposed along the right edge.

In aligning the sheet to the overlay, the opaque sheet is disposed between the first and second overlay (the second overlay includes corresponding apertures which vertically and horizontally align with apertures 336). The opaque sheet 344 is first positioned between the overlay by locating the centering dot 352 in centering area 342. The musician then adjusts the vertical relationship of the opaque sheet to the overlay until the registry line 348 for the desired key is disposed in the registry slit 340 of the corresponding aperture. Thereafter, the stud portion 358 of the button 354 would be disposed in the particular aperture for the key selected and a mating piece engaging the stud so as to lock in registry the sheet to the overlay. This would accomplish any horizontal movement necessary for alignment.

The other notations as previously described would be identically disposed on the sheet and overlays and would now be aligned as described before so as to enable the musician to play the music in the selected key.

Referring now to FIGS. 47 (a through d), there is described a camming arrangement which can be employed together with the key guide aligning schemes described above to properly set the desired key.

It comprises a specially configured opaque sheet 360 having a cutout portion 362. The sheet in this instance would also be of a heavier material such as that used in fabricating playing cards.

The cutout 362 includes ear-like projections 364 and 366 which are connected by a circular arc section 368 and semi-circular portion 370.

The center point of the semi-circular section 370 is shown at 372. The radius 374 is depicted for the circular arc section 368. The semi-circular portion connects to the ear-like extensions at corners 378 and 380.

Referring to FIG. 47*b*, there is shown a cam member 382. This includes a lobe portion 364 having a circular arc surface 386. The lobe comprises a substantially circular portion 388 which is connected to the aforementioned lobe portion 384. A vertical center line for subsequent discussion concerning the operation of the cam is depicted and is labeled 390. The circular portion 388 includes a center pivoting hole 392 and has a diameter 394. Radius 396 measured from the pivot hole 392 describes the circular arc portion 386.

FIG. 47*c* shows the cam 382 placed in relative position in the cutout 362. The cam is pivotally connected to one or both of the overlays on the inside surface thereof and sized to nest in the cutout portion of the opaque sheet 362. FIG. 47*c* illustrates the relative movement between the cam and the cutout so as to effect horizontal movement. As indicated, the cam moves an angular distance 398 to effect the horizontal movement designated 400. This enables the musician to select either the sharp or flat key signature scale. Thereafter by further rotating the cam from a position 390(2) to a position 390(3) through the angular distance 402, a vertical movement as reflected by 404 is effected which enables the musician to select one of the seven keys in either the sharp or flat signature (see FIG. 47*d*). It is to be understood that one has to rotate the cam completely to the other side from an initial position as shown by 390(1) to a desired further position so as to effect the selection of the key in the other signature grouping.

Referring now to FIG. 48, there is described still another means for registering the opaque sheet and the overlay. In this embodiment, the composite 406 includes the opaque sheet 408 which is disposed between the overlays comprising a continuous transparent envelope 410. The opaque sheet and overlays includes substantially all of the same respective notation that has been described previously.

The overlay material in this embodiment is a softer, more flexible plastic which adheres closely to the opaque sheet and which is formed in a closed sheet manner at the edges.

In aligning, the opaque sheet 408 is moved in the direction 412 until the desired letter of the key signature is aligned with the T portion of the aligning means depicted as in one of the previous embodiments. Thereafter, the overlay envelope is manipulated in the musician's hands, side to side, as indicated by arrows 414 and 416, until the sharp or flat signature as desired, is aligned, again, with the T portion of the aligning means in the manner described previously.

One interesting observation about this embodiment is that the spacing between a portion of the key signature and chord guide notation disposed behind the opaque areas and the windows are identical on the front and back in that the relative motion between the overlay and the opaque sheet is inherently opposite between the obverse and reverse sides.

The inventor has disclosed herein numerous embodiments depicting his invention. There will be obvious variations to those disclosed above all within the scope of the present invention.

For example, instead of having a single sheet of opaque material interposed between the overlays, with appropriate notations on both sides of the sheet but with one aligning means on the obverse side, two opaque sheets could be used having respective aligning means on the obverse and reverse sides. Vertically the two sheets would be shifted together until the desired key letter was selected; but then the sheets would be moved horizontally, independently, and in reverse directions, to the desired key. This would obviate the need for differing horizontal spacings between characters as described above with respect to FIGS. 4 and 5; 6 and 8; FIGS. 15 to 20, etc.

Again, other variations will be apparent but the breadth of the invention is to be limited only by the scope of the appended claims.

What is claimed is:

1. A system for devising a sheet of music and for transposing the music from one key to another comprising:

a first layer comprising transparent material having first indicia disposed thereon including staff lines, a first set of predetermined music notations, and opaque areas; a second layer comprising opaque material having second indicia disposed thereon including notes, and a second set of predetermined music notations; said first layer overlaying said second layer, said first and second layers relatively movable to each other; said opaque areas of said first indicia including a key signature area having windows substantially configured as sharps and flats and wherein said second indicia on said layer of opaque material includes a key signature area having a plurality of sharps and flats, substantially configured as such, and means for aligning said first layer and said second layer, whereby a desired key for the music can be selected, such that upon alignment of the sharp or flat windows of the selected key permit corresponding sharps or flats in the key signature area on said layer of opaque material to be visible therethrough; and whereby various ones of said second indicia on said second layer are obscured by corresponding opaque areas on said first layer.

2. A system for devising a sheet of music and for transposing the music from one key to another comprising:

first and second overlays of transparent material, having first indicia disposed thereon including staff lines, respective sets of predetermined music notations, and opaque areas;

a layer of opaque material movably interposed between said first and second overlays, said layer having second indicia disposed on at least one side thereof, including notes, and a second set of predetermined music notations; said opaque areas of said first indicia including a key signature area having windows substantially configured as sharps and flats and wherein said second indicia on said layer of opaque material includes a key signature area having a plurality of sharps and flats, substantially configured as such, and means for aligning said layer of opaque material with at least one of said overlays having said first and second printings thereon, whereby a desired key for the music can be selected, such that upon alignment of the sharp or flat windows of the selected key permit corresponding sharps or flats in the key signature area on said layer of opaque material to be visible therethrough; and, various ones of said second indicia on said layer of opaque material are obscured by corresponding opaque areas on said transparent overlays.

3. The system claimed in claim 2 wherein said layer of opaque material comprises:

two sheets of opaque material movably interposed between said first and second overlays, said first sheet including said second indicia disposed on only one side thereof, said side with said indicia disposed thereon facing said first overlay, said second sheet including a respective set of second indicia on only one side thereof, facing said second overlay; and means for aligning each of said sheets with their respective overlays.

4. They system claimed in either claim 1, 2 or 3 wherein said means for aligning includes means for aligning said opaque layer or sheet with the corresponding first layer or transparent overlay in each of two directions of movement of said opaque layer relative to said first layer or overlays.

5. The system claimed in either claim 1, 2 or 3 wherein said means for aligning includes means for aligning said opaque layer or sheet with the corresponding first layer or transparent overlay in each of two directions of movement of said opaque layer or sheet(s) relative to said first layer or overlays, wherein said directions are at right angles to each other, one in the direction of the length of the combination and the other in the direction of the width.

6. The system claimed in claim 2 or 3 wherein said first and second overlays are attached on opposite edges.

7. The system claimed in claim 2 wherein said second indicia is disposed on both sides of said layer of opaque material, and wherein said first indicia and said second indicia include cooperating notations to form any desired key upon alignment, each of the cooperating notations forming part of either said first indicia or said second indicia on respective sides of the system, having dimensional relationships to compensate for the difference in relative movement between said layer of opaque material and each of said overlays during the aligning process.

8. The system claimed in claim 1 or 2 wherein said means for aligning comprises:

(a) a plurality of first aperture openings disposed along each edge of said layer of opaque material at predetermined locations, the number of openings corresponding to the number of keys;

(b) key selecting indicia disposed adjacent to respective ones of said openings, said selecting indicia including a line connecting each said opening to a corresponding indicia for a particular key;

(c) centering indicia disposed among said key selecting indicia;

(d) a plurality of second aperture openings disposed along each edge of said transparent layer or overlays at positions corresponding to the locations of said first aperture openings;

(e) key selection opaque areas disposed on said transparent layer or overlays, one of each said key selection opaque areas disposed adjacent to said second openings, said opaque area including windows for viewing said centering indicia and the lines emanating from each of said first openings to a corresponding key; and (f) means for registering said layer of opaque material to said transparent layer or overlays disposed in one of said corresponding first and second openings, representing the desired key.

9. The system claimed in claim 1 or 2 wherein at least one edge of said layer of opaque material is cut to a predetermined configuration including first and second cutouts at respective ends of said edge, and a plurality of notches disposed in a predetermined arrangement along said edge in said second cutout, and means for aligning including key designating indicia forming a part of said second indicia on said opaque layer, said key designating indicia disposed in predetermined location relative to said plurality of notches, said means for aligning further including first and second clips cooperatively configured to the shape of said first and second cutouts, said second clip including a tooth-like projection cooperatively shaped with the shape of each said notch, said second clip further including cooperating means for registering its position along the edge of said second cutout at a point corresponding to a desired key in said key designating indicia, said first clip cooperating with said first cutout and said layer or overlays of transparent material to fixedly secure said layer of opaque material to said layer or overlays of transparent material when the desired key is selected.

10. The system claimed in claim 1 or 2 wherein said means for aligning includes:

a cam rotatably mounted to the first layer or at least one of said overlays;

said opaque material having a first cutout of predetermined shape, said cutout disposed contiguously with said cam, said cam nesting in said first cutout;

said cam rotatable among a plurality of positions in said cutout corresponding to a desired key, the rotational movement of said key effecting movement of said opaque material layer relative to said transparent layer or overlays, whereby a desired key can be selected.

11. The system claimed in either claim 1, 2 or 3 wherein said first and second indicia include cooperating printings disposed on said overlay or overlays and the respective side of said opaque layer, the cooperating printing on said overlay(s), including a plurality of alternating rows of windows and Roman numerals representing music chords, the cooperating printing on said opaque layer including a plurality of rows of indicia, each said row of indicia having a predetermined sequence of letters with or without a sharp or flat associated therewith, each said row further including row designation indicia associated therewith, said rows of windows including windows for viewing said letters, windows for viewing the sharp or flat associated with a corresponding letter and windows for viewing said row designation indicia, whereby when said first layer is aligned with said second layer, the letter and associated sharp or flat corresponding to each of said Roman numerals appear through the windows of the row identified by the row designation indicia as viewed through the windows for viewing same.

12. The system claimed in claim 1 or 2 wherein said means for aligning comprises:

(a) first and second sets of lines and key designating indicia associated with each line in each set disposed on said layer of opaque material at predetermined locations, said lines disposed parallel to each other and to the staff lines, one end of said lines terminating in a line perpendicular to said parallel lines, the other end terminating at respective key designating indicia; and (b) third and fourth indicia disposed on said first layer or overlay of transparent material in cooperating locations with said first and second sets of lines, said third and fourth indicia having a Tee shape and orientated on said first layer or overlay in a predetermined position whereby, when selecting a desired key, one line of the Tee is made to align linearly with the line in said first or second set of lines associated with the desired key, and the cross member of said Tee aligns colinearly with the corresponding line terminatin the ends of lines in the set containing the desired key.

13. The system claimed in claim 1 or 2 wherein said means for aligning comprises:

(a) first and second set of lines and key designating indicia associated with each line in each set disposed on said layer of opaque material at predetermined locations, said lines disposed parallel to each other and to the staff lines, one end of said lines terminating in a line perpendicular to said parallel lines, the other end terminating at respective key designating indicia; and (b) third and fourth indicia disposed on said first layer or overlay of transparent material in cooperating locations with said first and second sets of lines, said third and fourth indicia having a Tee shape and orientated on said first or overlay in a predetermined position whereby, when selecting a desired key, one line of the Tee is made to align linearly with the line in said first or second set of lines associated with the desired key, and the cross member of said Tee aligns colinearly with the corresponding line terminating the ends of lines in the set containing the desired key, said cross member of said Tee shape indicia having an opaque color substantially identical to the color of said opaque layer.

14. A system for devising a sheet of music and for transposing the music from one key to another comprising:

a first layer comprising transparent material having first indicia disposed thereon including staff lines, a first set of predetermined music notations, and opaque areas; a second layer comprising opaque material having second indicia disposed thereon including notes, and a second set of predetermined music notations;

said first layer overlaying said second layer, said first and second layers relatively movable to each other;

said opaque areas of said first indicia, including a key signature area having a plurality of vertical lines printed therein at predetermined locations on said staff lines, a first set of said vertical lines corresponding to the sharps and a second set of said vertical lines corresponding to the flats, said key signature area of said opaque area of said first indicia further including window areas configured to represent the cross members of the sharps and the remaining body portion of the flats, and wherein said second indicia on said layer of opaque material includes a key signature area having a plurality of cross members of sharps and body portion of flats in predetermined locations, and means for aligning said first layer and said second layer, whereby a desired key for the music can be selected and whereby upon alignment the windows in the key signature area for the selected key permit corresponding indicia representing sharps and flats to be visible therethrough, and whereby the vertical lines associated with the selected key signature cooperate with the indicia viewed through the windows to present to the observer the desired notation for the selected key and whereby various ones of said second indicia on said second layer are obscured by corresponding opaque areas on said first layer.

15. A system for devising a sheet of music and for transposing the music from one key to another comprising:

first and second overlays of transparent material, having first indicia disposed thereon including staff lines, respective sets of predetermined music notations, and opaque areas;

a layer of opaque material movably interposed between said first and second overlays, said layer having second indicia disposed on at least one side thereof, including notes, and a second set of predetermined music notations;

said opaque areas of said first indicia, including a key signature area having a plurality of vertical lines printed therein at predetermined locations on said staff lines, a first set of said vertical lines corresponding to the sharps and a second set of said vertical lines corresponding to the flats, said key signature area of said opaque area of said first indicia further including window areas configured to represent the cross members of the sharps and the remaining body portion of the flats, and wherein said second indicia on said layer of opaque material includes a key signature area having a plurality of cross members of sharps and body portion of flats in predetermined locations, and means for aligning said layer of opaque material with at least one of said overlays having said first and second printings thereon, whereby a desired key for the music can be selected and whereby upon alignment the windows in the key signature area for the selected key permit corresponding indicia representing sharps and flats to be visible therethrough, and whereby the vertical lines associated with the selected key signature cooperate with the indicia viewed through the windows to present to the observer the desired notation for the selected key, and whereby various ones of said second indicia on said layer of opaque material are obscured by corresponding opaque areas on said transparent overlays.

* * * * *

UNITED STATES PATENT AND TRADEMARK OFFICE

CERTIFICATE OF CORRECTION

PATENT NO. : 4,434,698

DATED : March 6, 1984

INVENTOR(S) : Charles N. Oberlander

It is certified that error appears in the above-identified patent and that said Letters Patent is hereby corrected as shown below:

Title Page, Item No. 75, after the inventor's name, delete "--- El Paso, Tex. ---" and insert "--- 5550 Fredricksburg Rd., No. 509, San Antonio, Tex. 78229 ---"

Title Page, Item No. 73, after "Assignees"

delete "---Ronald H. Miskin, Lake Hopatcong; James T. Pappas, Chatham; W. Patrick Quast, Waldwick, all of N.J.; part interest to each ---"

and insert "--- None ---"

Signed and Sealed this

*Thirty-first* Day of *July 1984*

[SEAL]

*Attest:*

GERALD J. MOSSINGHOFF

*Attesting Officer*

*Commissioner of Patents and Trademarks*